US008166984B2

(12) United States Patent
Cerruti et al.

(10) Patent No.: US 8,166,984 B2
(45) Date of Patent: May 1, 2012

(54) DISPENSER OF WASHING AGENTS FOR A HOUSEHOLD WASHING MACHINE, IN PARTICULAR A DISHWASHER

(75) Inventors: Daniele Cerruti, Fontanetto Po (IT); Costanzo Gadini, Frassineto Po (IT)

(73) Assignee: Eltek S.p.A., Casale Monferrato (Alessandria) (IT)

( * ) Notice: Subject to any disclaimer, the term of this patent is extended or adjusted under 35 U.S.C. 154(b) by 707 days.

(21) Appl. No.: 12/276,475

(22) Filed: Nov. 24, 2008

(65) Prior Publication Data

US 2009/0133727 A1 May 28, 2009

(30) Foreign Application Priority Data

Nov. 23, 2007 (IT) ..... TO2007A0847
Nov. 20, 2008 (EP) ..... 08169551

(51) Int. Cl.
*D06F 39/02* (2006.01)

(52) U.S. Cl. ..... 134/99.2; 68/17 R

(58) Field of Classification Search ..... 134/93, 134/99.2; 68/12.04, 17 R; 222/165, 631
See application file for complete search history.

(56) References Cited

U.S. PATENT DOCUMENTS

| | | | | |
|---|---|---|---|---|
| 6,374,444 | B2 * | 4/2002 | Skrippek et al. | 8/159 |
| 2003/0182732 | A1 * | 10/2003 | Davenet et al. | 8/158 |

FOREIGN PATENT DOCUMENTS

| | | | | |
|---|---|---|---|---|
| DE | 3107136 | A1 | | 9/1982 |
| DE | 19757679 | A1 | | 7/1989 |
| DE | 195 35 153 | A1 | | 3/1997 |
| DE | 019535153 | | * | 3/1997 |
| DE | 19535153 | A1 | | 3/1997 |
| DE | 195 35 153 | B4 | | 5/2005 |
| DE | 19535153 | B4 | | 5/2005 |
| DE | 19757679 | B4 | | 1/2008 |
| EP | 0 602 572 | B1 | | 7/2002 |
| WO | WO 03/096867 | A2 | | 11/2003 |
| WO | WO 03/096867 | A3 | | 11/2003 |
| WO | WO 2006/048765 | A2 | | 5/2006 |
| WO | WO 2006/048765 | A3 | | 5/2006 |
| WO | WO 2007/017755 | A1 | | 2/2007 |

OTHER PUBLICATIONS

European Search Report from corresponding European priority application No. EP08169551.2 dated Jun. 17, 2009.

* cited by examiner

*Primary Examiner* — Saeed T Chaudhry
(74) *Attorney, Agent, or Firm* — Heslin Rothenberg Farley & Mesiti P.C.; Victor A. Cardona

(57) ABSTRACT

A dispenser of washing agents for a dishwasher has a body with a reservoir configured for containing a total amount of a liquid substance sufficient for performing a number of cycles of operation of the dishwasher. The reservoir has a charging passage that can be engaged by a removable plug, and the dispenser has a system for dosage of the liquid substance contained in the reservoir. The plug is configured for co-operating with an adjustment element belonging to the dosage system when the plug itself is at least partially inserted in the charging passage, particularly in such a way that a movement of rotation manually imparted on the plug will bring about a movement of rotation of the adjustment element.

20 Claims, 11 Drawing Sheets

Fig. 1
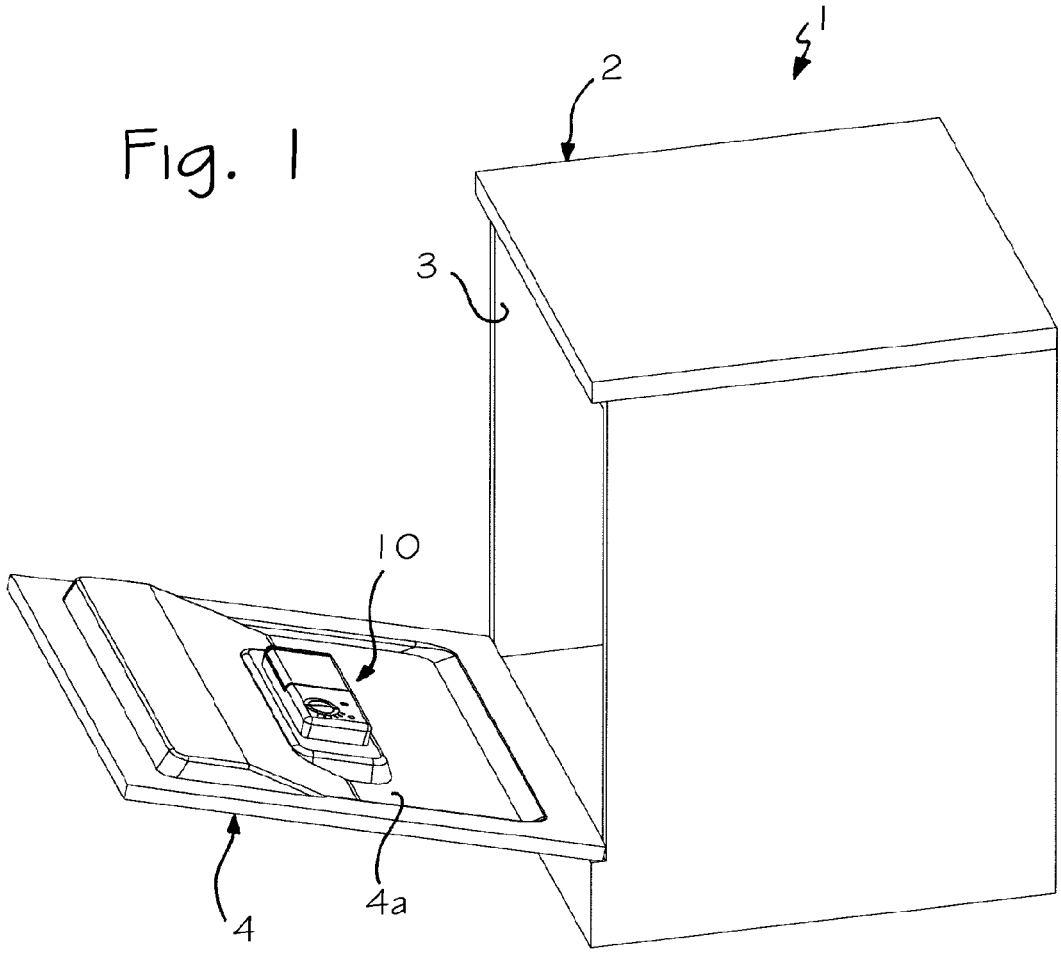
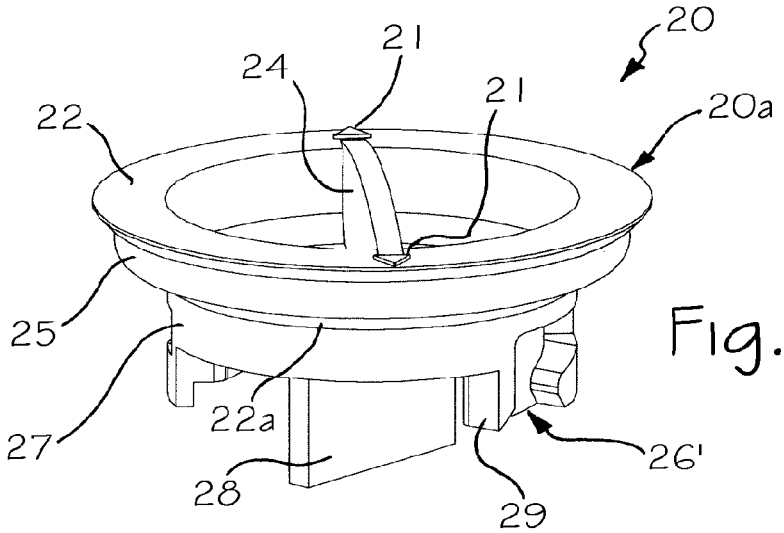
Fig. 18

Fig. 2
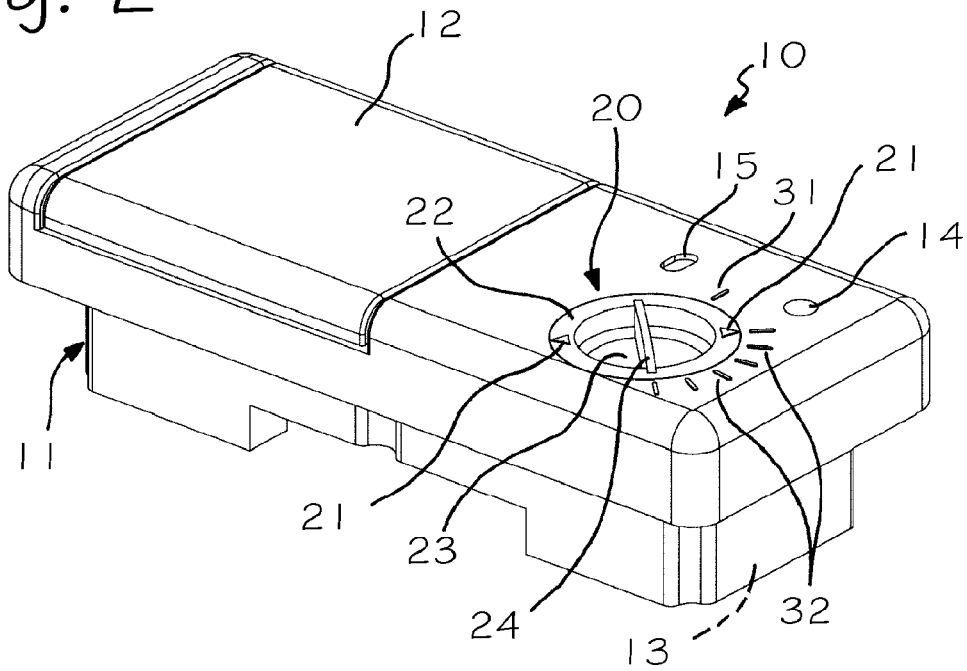
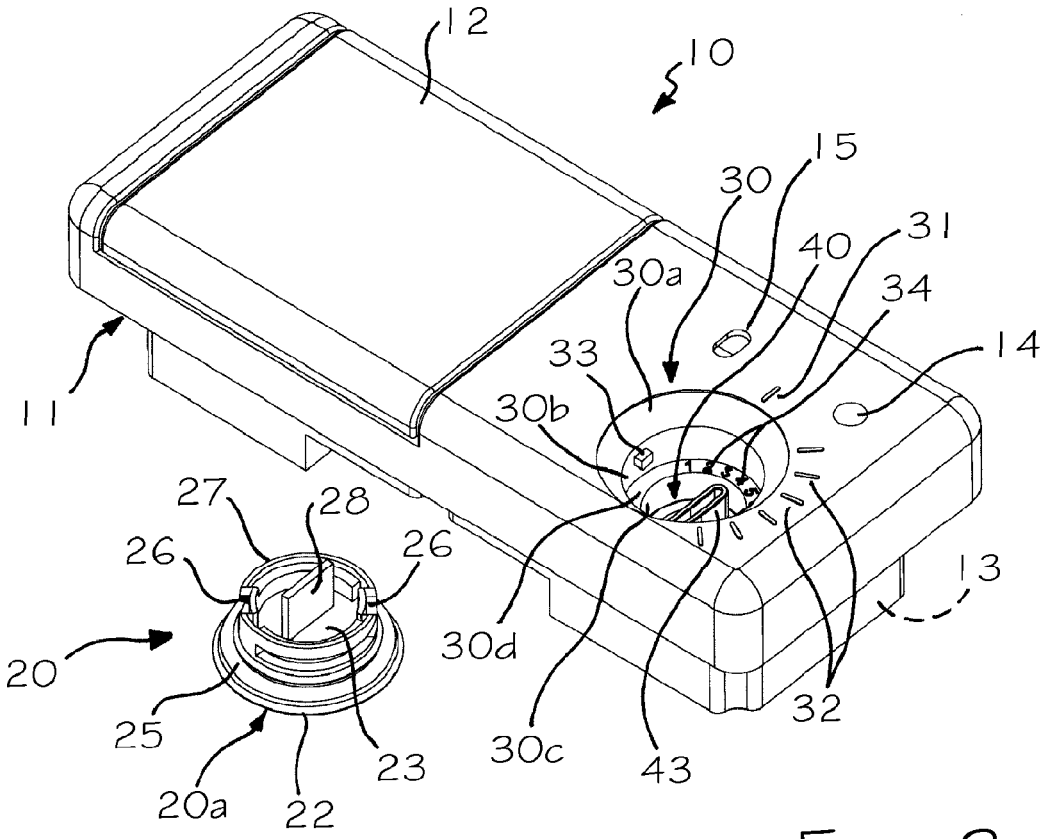
Fig. 3

DISPENSER OF WASHING AGENTS FOR A HOUSEHOLD WASHING MACHINE, IN PARTICULAR A DISHWASHER

CROSS REFERENCE TO RELATED APPLICATIONS

This application claims priority from Italian Patent Application No. TO2007A000847 filed on Nov. 23, 2007, and European application No. 08169551.2, filed Nov. 20, 2008, the entire disclosures of which are incorporated herein by reference.

FIELD OF THE INVENTION

The present invention relates to dispensers of washing agents for household washing machines and has been developed with particular reference to dispensers for dishwashers.

DESCRIPTION OF THE PRIOR ART

Dishwashers are typically provided with a dispenser of washing agents, which is generally configured for delivering, at different moments of one dish-washing cycle, two different washing agents, typically represented by a detergent in powder form or in the form of a tablet and by a liquid rinse aid or lustering agent. Known to the art are also dispensers provided for dispensing a liquid substance only.

In the most widespread solutions, the body of the dispenser, which is usually fixed to the internal face of a front door of the machine, defines inside it a reservoir that is able to contain an amount of the liquid washing agent sufficient for performing a number of washing cycles. The dispenser is also provided with a system designed to cause selective delivery of individual amounts of the liquid washing agent. The volume of the deliverable amounts must be adjustable or pre-settable, for example according to the type of liquid agent used, or else according to the degree of hardness of the water, or else again according to precise choices of the user.

In the majority of the known solutions, division of the content of the reservoir into individual deliverable amounts is carried out exploiting the movement of opening of the door of the machine, which is substantially vertical when closed and substantially horizontal when open. Very schematically, the system for dosage and delivery comprises a member for adjusting the dose of rinse aid, which has a dosage element, such as a tray or a small chamber. In certain solutions, when the door of the machine is brought into the horizontal position, i.e., the opening position, a part of the rinse aid contained in the corresponding reservoir can pass into the aforesaid dosage element, for example a tray. Then, when the door of the machine is re-closed, the dose of rinse aid that remains in the dosage tray provides the individual dose that is then delivered.

In order to be able to vary the volume of the deliverable amounts the aforesaid adjustment member that integrates the dosage tray can be positioned by the user in one from amongst a plurality of possible pre-defined angular positions. These dosage and adjustment systems are widely known, and consequently their description is omitted herein. The reader is referred, purely by way of reference, to the documents DE-A-310 71 36, DE-A-197 57 679 and DE-A-195 35 153 as examples of known techniques for providing systems of volumetric adjustment of the amounts of liquid washing agent that can be delivered by a dispenser.

The adjustment member is mounted so that it can turn axially inside the body of the dispenser in an area corresponding to the passage for charging the rinse aid into the reservoir, in such a way that a portion thereof is accessible just through said passage. This accessible part includes a first visual reference, such as a mark or an arrow, and in turn present within the charging passage are second visual references, for example marks or numbers, of the possible alternative adjustment positions for the member. Hence, in order to set the volumes of the amounts, the user can turn the adjustment member within its housing so as to align the aforesaid first reference to one from among the second references, which represent possible amounts for the deliverable doses.

In order to be able to turn the adjustment member, the user must typically insert at least two fingers in the passage for charging the rinse aid. This operation is inconvenient, above all when it is carried out by persons with relatively big fingers. Some users, in order to perform the adjustment operation, use makeshift tools, such as a screw-driver or the tip of a knife, but this has often the effect of ruining or at least damaging the accessible part of the adjustment member, which is usually configured as a piece made of moulded thermoplastic material.

There have also been proposed dispensers provided with adjustment members that project or have parts projecting on the outside of the dispenser body. Said solutions present, however, various drawbacks, such as the high risk of accidental variation of the adjustment set, the risk of poor sealing of the adjustment member with respect to the liquid-agent reservoir, the risk of jamming following upon deposit of dirt resulting from the washing process.

SUMMARY OF THE INVENTION

The present invention proposes a solution to the aforementioned drawbacks, in particular by providing a dispenser of washing agents for a household washing machine, in particular a dishwasher, in which the volumetric adjustment of the amounts of liquid washing agent that may be delivered can be carried out in a simple and convenient way by the user. Another purpose of the present invention is to provide a dispenser of the above sort that is extremely simple and economically advantageous to produce. A further purpose of the invention is to provide a dispenser of the above sort, the encumbrance of which towards the inside of a tank of a dishwasher will not be penalized as compared to the known solutions.

The above and other purposes still, which will emerge more clearly hereinafter, are achieved according to the present invention by a dispenser of washing agents for a household washing machine, in particular a dishwasher, having the characteristics of the annexed claims. The claims constitute an integral part of the technical teaching provided herein in relation to the invention.

BRIEF DESCRIPTION OF THE DRAWINGS

The characteristics and advantages of the invention will emerge clearly from the ensuing detailed description, with reference to the annexed drawings, which illustrate preferred, though non-exclusive, embodiments of the invention. In the drawings:

FIG. 1 is a schematic perspective view of a dishwasher incorporating a dispenser of washing agents according to the present invention;

FIGS. 2 and 3 are perspective views of a dispenser made in accordance with a first embodiment of the invention, in two different conditions;

FIG. 18 is a perspective view at an enlarged scale of a component according to a possible variant of the invention;

DETAILED DESCRIPTION OF PREFERRED EMBODIMENTS OF THE INVENTION

Figure 4:
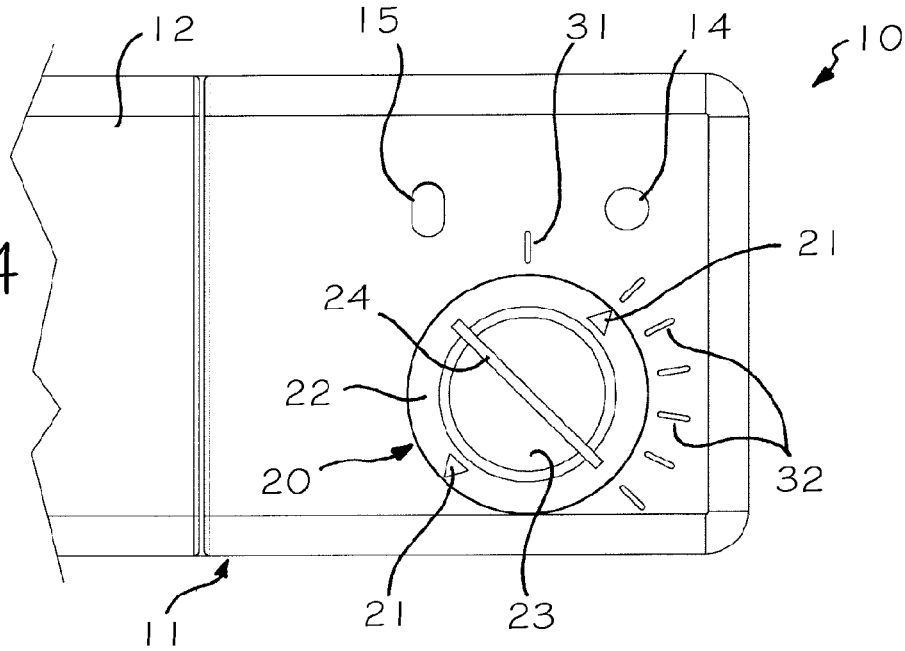
FIGS. 4 and 5 are two partial views in front elevation of the dispenser according to the invention in conditions corresponding to those of FIGS. 2 and 3, respectively.

In FIG. 1, designated as a whole by 1 is a washing machine equipped with a device for dispensing washing agents provided according to the present invention. In the case exemplified, the machine 1 is a dishwasher having a cabinet 2 defining inside it a washing tank or chamber 3. Designated as a whole by 4 is a front door of the machine 1, hinged to the cabinet 2 so as to turn according to a substantially horizontal axis. The internal face of the door 4 provides the front surface of the tank 3 and mounted therein, in an area corresponding to an opening thereof, a dispenser of washing agents according to an example of embodiment of the present invention, designated as a whole by 10. The invention can in any case be applied also to dispensers for washing machines of other types and/or ones having a configuration different from the one represented. For a greater clarity of representation, in FIGS. 2-9 the dispenser 10 has been represented alone or isolated, i.e., in a condition where it is not mounted on the door 4.

The machine 1 then comprises all the elements normally known for its operation, which will not be described herein.

With particular reference to the preferential example of FIGS. 2 and 3, the dispenser 10 has a body 11, preferably formed by a front part and a rear part joined together, for example, by welding, according to known techniques. Once again according to the known art, the body 11 defines an outer cavity designed to contain a first washing agent, in particular a detergent in powder form or in the form of a tablet. Said cavity is closed by a hatch that can be tipped, designated by 12, hinged at one of its ends to the body 11, according to known techniques. The practical construction of the system for delivering the solid detergent is not described herein, in so far as it is in itself known and falls outside the scope of the present invention. It should in any case be taken into account that the hatch 12 could be mounted so that it slides on the body 11, instead of being tippable, or else be of some other type.

Defined inside the body 11 is a reservoir for a liquid washing agent, which here is assumed as being a rinse aid. The capacity of said reservoir, which is designated as a whole by 13, is such as to be able to contain a total quantity of rinse aid sufficient for performing a number of washing cycles by the dishwasher 1. On the other hand, the dispenser 10 has a system for dosage and delivery of the rinse aid, of a generally known conception, except for the corresponding means for adjustment of the dosage amounts, preferably represented by adjustment means of a volumetric type, which form the specific subject of the present invention and will be described hereinafter in detail.

Designated by 14 is an optical indicator for indicating the level of rinse aid contained in the reservoir 13, provided according to known techniques. Designated by 15 is an opening for delivery of the rinse aid. As has been said, the delivery system of the dispenser device according to the invention is conceived according to the known art and consequently will not be described in detail herein. Purely by way of example, the actuation system aimed at producing both delivery of the detergent in solid form and that of the rinse aid can be of the type described in EP-A-0 602 572 or else in WO 2007 017755, filed in the name of the present applicant, the teachings of which are considered as being incorporated herein. The system for delivering the contents of the reservoir 13 in single substantially pre-defined dosage amounts is preferably of the known type cited in the introductory part of the present description, which exploits the movements of opening and closing of the door 4 of the machine. Said system could also be of any other type.

Designated as a whole by 20 is a removable plug, which can be selectively engaged in a passage or charging conduit of the reservoir 13, said passage being designated as a whole by 30 in FIG. 3.

According to a preferred characteristic of the invention, provided on the front surface of the body 11 of the dispenser 10, in an area close to the edge of the passage 30, is a plurality of visual references. In the example shown, said references are represented by simple marks that are the same as one another, but it should be taken into account that the modes of production and graphic representation of the aforesaid references can be of any type. For example, the references could be obtained in relief by moulding of the body 11, or else be impressed with indelible ink or silk-screen printing, and comprise numbers, letters, abstract symbols, etc.

Figure 5:
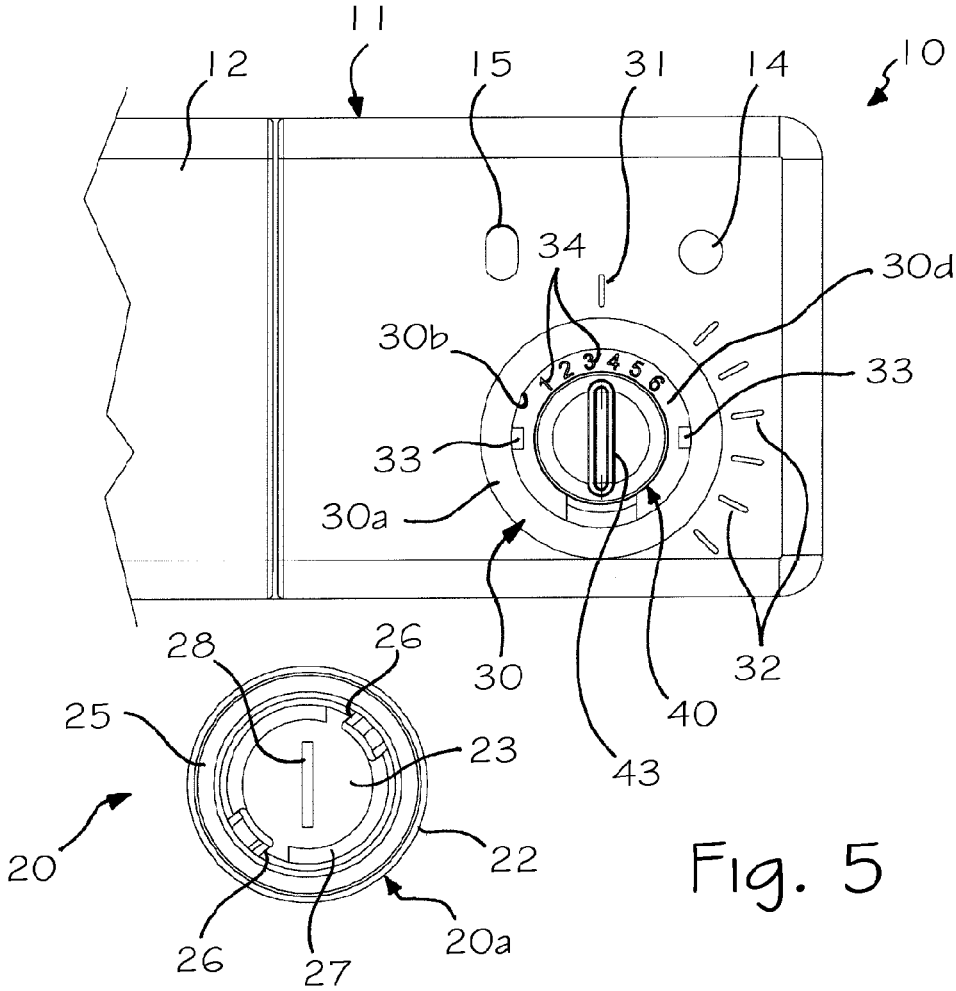

As may be seen also in FIGS. 4 and 5, the aforesaid references, designated by 31 and 32, are set according to a generally arched configuration, i.e., along the circumferential rim of the inlet of the charging passage 30. There may be identified in particular a first reference 31 and a series of second references, designated as a whole by 32 and substantially set at equal distances apart form one another. The distance between the reference 31 and the first reference 32 of the series (in the clockwise direction, as viewed in FIGS. 4 and 5) is greater than the distance between any two references 32. As will emerge more clearly hereinafter, the reference 31 is aimed at indicating a pre-defined position of insertion/extraction of the plug 20 with respect to the passage 30, whilst the references 32 designate various possible alternative positions of an adjustment member belonging to the system for dosage and delivery of the rinse aid.

Figure 6:
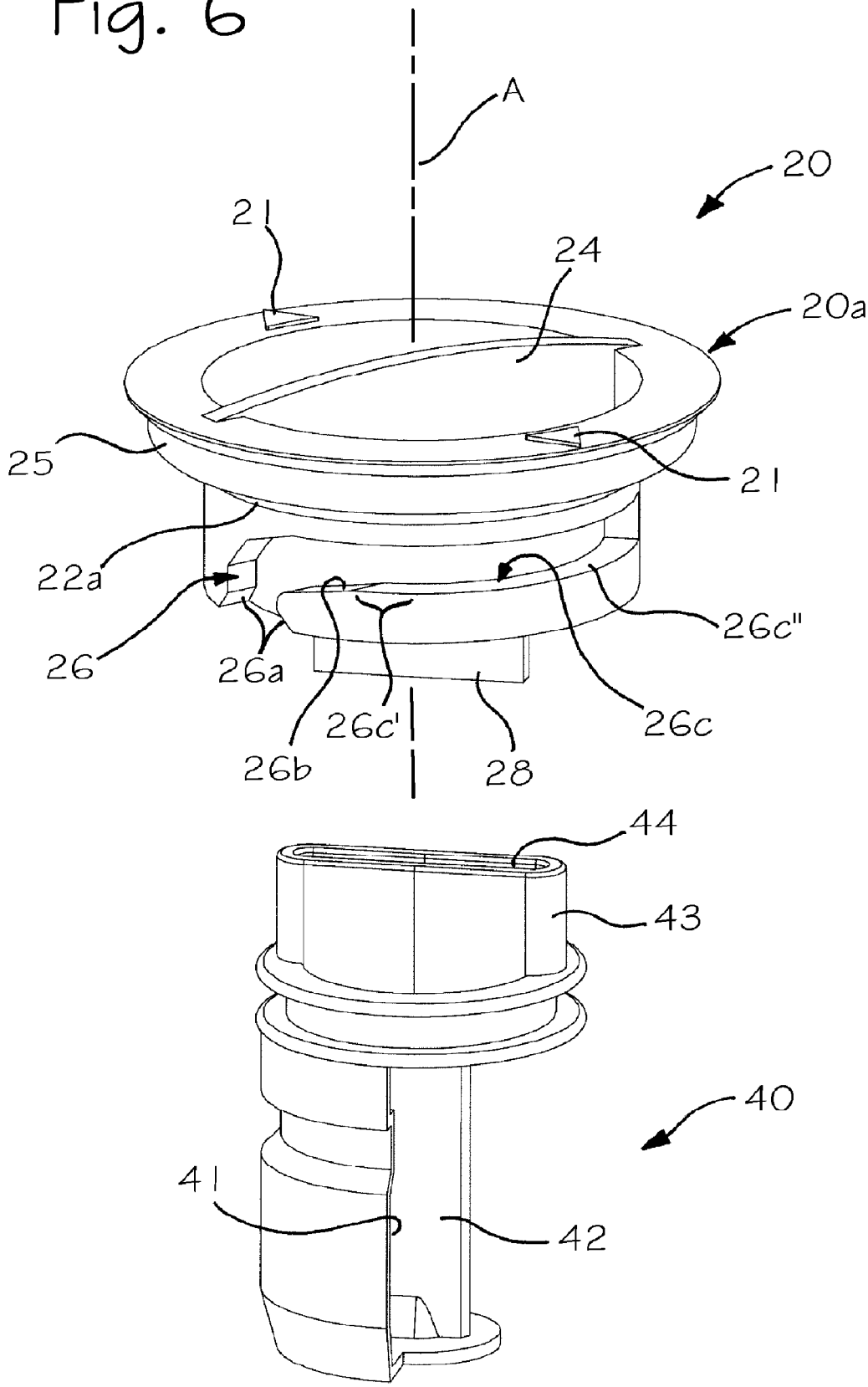
FIG. 6 is a perspective view at an enlarged scale of two components of the dispenser of FIGS. 2-5.

With reference also to FIG. 6, the plug 20 comprises a main body 20*a*, which has, in a portion thereof that is to remain on the outside of the passage 30, two references 21. These references, here having the shape of an arrow in relief, are provided in diametrally opposite positions on a portion with annular flange 22 of the body 20*a*. The presence of two references 21 enables a user to mount the plug 20 without any concern for the relative angular position of insertion in the passage 30. On the other hand, in the example illustrated, after insertion of the plug 20 in the passage 30, only one of the references 21 will prove to be operative, i.e., co-operating with the references 31, 32 for providing indications to the user, as will emerge clearly hereinafter. In one variant, further references 31, 32 can also be provided in an opposite position to the one represented (i.e., rotated through 180°), in such a way that both of the references 21 of the plug will correspond operatively to respective references 31, 32, thus enabling the user to see the various positions of adjustment from a number of angles of view.

In the outer portion of the body 20*a* is formed a substantially cylindrical cavity, which is delimited at the bottom by a wall 23 (FIG. 2) and is traversed diametrally by a transverse wall 24.

As may be seen in FIG. 3, the charging passage 30 has an upper portion 30*a* of a generally flared shape or having the shape of a truncated cone, on which a gasket 25 of the plug 20 is designed to operate in a fluid-tight way. Underneath the surface 30*a* (as viewed in the figures) the passage 30 then has a first portion and a second portion, both of which have a generally cylindrical shape, designated by 30*b* and 30*c* respectively, the portion 30*c* having a smaller diameter than the portion 30*b*, and at least partially projecting in said portion 30*c* is an adjustment member 40, preferably of a volumetric type, which is mounted so that it can turn according to an axis substantially coinciding with the central axis of the passage 30, and which preferably cannot be extracted from the passage itself. Defined between the portions 30*b* and 30*c* is a step having an annular surface or band 30*d*, which is substantially parallel to the front of the body 11. Present on the surface 30*c* are position references for the adjustment member 40. In the example illustrated, these references, designated as a whole by 34, are in the form of numbers obtained along with moulding of the body 11. Obviously, also the references 34 could be of a different type from the one represented.

Formed in the cylindrical portion 30*b* are two portions in relief 33, in diametrally opposite positions and projecting substantially radially towards the inside of the passage 30, said portions in relief being part of a bayonet-coupling system that provides means for mutual coupling between the passage 30 and the plug 20.

As has been seen, the plug 20 and the member 40 are configured as separate components. However, according to an inventive aspect, the plug 20 is designed to co-operate with the adjustment member 40 in order to enable variation of the position of the member itself from outside the dispenser 10, in particular without any part of the adjustment member projecting towards the outside of the dispenser. In the embodiment of FIGS. 1-9, the plug 20 is shaped in such a way as to co-operate mechanically with the adjustment member 40 and envisages for this purpose means designed to co-operate with, or be associated to, the adjustment member 40. In other possible embodiments of the invention, however, the co-operation or operative coupling between the removable plug of the reservoir for the liquid washing agent and the system for dosage and delivery of the basically pre-defined amounts of the same agent can be of some other type, as will emerge hereinafter.

Shown in perspective view in FIG. 6 are the plug 20 and the member 40.

The body 20*a* of the plug 20 is preferably made of a single piece via moulding of thermoplastic material. As previously mentioned, the body 20*a* has an upper portion designed to remain at least in part accessible from outside the body 11 of the dispenser 10. This portion basically comprises the annular-flange part 22 and the substantially cylindrical cavity, which is closed at the bottom by the wall 23 (see also FIGS. 3 and 4), which is traversed diametrally by the transverse wall 24, the latter providing a means to enable the user to grip the plug 20. The means for gripping the plug 20 could be of some other type and/or shape, possibly made at least in part separately and then associated or fixed to the plug itself.

As has been said, made or impressed on the outer surface of the flange-shaped part 22 are the two references 21. Underneath the flange-shaped part 22 the body of the plug 20 has a cylindrical region 22*a*, which defines with the wall 23 the aforesaid cavity traversed by the wall 24. This cylindrical region 22*a* provides a positioning seat for the gasket 25, which in the example provided is a seal of the O-ring type, preferably made of elastomeric material.

The plug 20 and the corresponding passage 30 are equipped with means for mutual coupling, said means being configured to keep, in at least one condition of engagement thereof, the plug 20 in a position such that it provides a fluid-tight seal of the passage 30, whilst, in a condition of release thereof, said means enable extraction of the plug 20 from the passage 30.

In the example of embodiment represented, the aforesaid means for mutual coupling are constituted by a bayonet coupling, which comprises, in addition to the portions in relief 33 formed in the portion 30*b* of the passage 30, engagement seats or guides 26 formed in the portion of the body of the plug 20 underneath the region 22*a* for positioning of the gasket 25.

For said purpose, as may readily be understood in particular from FIG. 6, the body of the plug 20 has a smaller portion, which is preferably hollow and open at the bottom, delimited by a cylindrical wall 27 and by the wall 23 (see FIGS. 3 and 5). Made in the cylindrical wall 27 are guides 26, here in the form of shaped recesses or grooves.

The guides 26 are not of a traditional type, but are instead preferably configured for contributing to achieving the purposes of the invention. Each seat 26 comprises an inlet 26*a*, open on the bottom edge of the wall 27, through which a respective portion in relief 33 can penetrate into the seat. The seat 26 further defines a resting surface, designed to co-operate with a respective portion in relief 33 in order to cause both compression of the gasket 25 and withholding of the plug 20 inside the passage 30. The resting surface of the seat 26 comprises a first portion or ramp 26*b*, which is generally inclined with respect to a plane orthogonal to the axis A of the plug 20. The aforesaid resting surface proceeds then with a second portion 26*c*, which is decidedly more extensive in length than the inclined surface portion 26*b*. The portion 26*c* is basically plane, i.e., it lies substantially in a plane perpendicular to the axis A of the plug 20. It should be noted that portion 26*c* of this sort represents a peculiar characteristic of the bayonet coupling illustrated, i.e., innovative with respect to the plugs of a known type. The two seats 26, formed in diametrally opposite positions of the cylindrical wall 27, are of similar conception, but evidently oriented in opposite ways with respect to one another.

Finally, from FIGS. 3, 5 and 6 it should be noted how the body of the plug 20 has at the bottom an axial element 28, such as a projection or an appendage, which departs from the bottom wall 23. In the example illustrated, the appendage 28 has a generally flattened shape, with quadrangular cross section, and a longitudinal development such that its free end will project beyond the bottom edge of the cylindrical wall 27. The conformation of the appendage illustrated must not be understood as in any limiting the scope of the invention: the axial element 28 could in fact be of some other type, and possibly be configured completely or partially as a component separate from the plug 20, and hence associated or fixed to the plug itself.

Once again visible in FIG. 6 is the adjustment member 40. As already explained previously, the system for adjustment of the volume of the doses of rinse aid regarding the example of embodiment described here is of a generally known type, apart from the specific characteristics that will be described hereinafter. The member 40 forms part of said system and basically comprises a body, preferably made of a single piece of thermoplastic material, which defines a substantially semi-cylindrical dosage tray, designated by 41. The tray 41 is divided in a longitudinal direction substantially into two halves or parts, via a diaphragm or partition wall 42. This conformation of tray is widely known in the sector and is, for example, used in dispensers produced and marketed by the present applicant.

The reader is, however, referred also to the prior documents cited in the introductory part of the present description, which illustrate possible alternative examples of embodiment of the tray of a dosage member, which can be used also for the purposes of practical implementation of the present invention.

As regards what is of specific interest herein, the member 40 has a connection or coupling part, which is able to co-operate with the plug 20 in such a way that a rotation or movement of the plug itself will be transferred to the member 40. In the example, this coupling part is provided in the upper area of the member 40 and is shaped so as to engage with the appendage 28 provided in the bottom area of the plug 20, i.e., so as to co-operate mechanically with said appendage.

In the example of embodiment illustrated, the upper coupling part of the member 40, designated by 43, has a generally prismatic shape and defines a seat or recess 44 of oblong cross section, inside which an end portion of the appendage 28 is designed to be received when the plug 20 is inserted in the passage 30.

It should be noted that, in a variant not shown, there could possibly be provided also additional coupling means, designed to be set between the plug 20 and the member 40, and configured for transferring at least part of the movement of the plug 20 to the member 40. In said solution, hence, the plug and the member couple to one another in an indirect way, via the aforesaid interposed means, which can for example be configured as a distinct component with respect to the plug 20 and the member 40 that can couple or engage in its upper part to the plug and in its bottom part to the adjustment member (for example, a disk-shaped element that, in its upper part, has a recess designed to receive the appendage 28 and, in its bottom part, a portion in relief designed to engage in the seat 44).

The appendage 28 and the coupling part 43, and possibly the aforesaid additional interposed means, preferably have shapes that at least in part are complementary with one another (said shapes may of course differ from the ones provided herein by way of example), even though this is not strictly indispensable for the purposes of implementation of the invention. Irrespective of the specific conformation, in fact, it is sufficient for the plug 20 to present in a bottom portion thereof an engagement means (the appendage 28, in the example) designed to co-operate mechanically with an engagement means (the part 43, in the example) provided in a portion of the member 40, so as to enable a movement of rotation of the plug will to cause a movement of the member 40. Obviously, a reverse arrangement is possible opposite to the one exemplified in the figures, i.e., such that it is the plug 20 that has a bottom part that receives a portion in relief of the member 40, which is preferably axial and projects in the direction of the plug.

In the example illustrated, the part 43 of the member 40 is accessible inside the passage 30, when the plug 20 is removed (see FIGS. 3 and 5): therefore, possibly, the part 43 could also be used directly as means for gripping the member 40, in order to turn it, given also the presence of the references 34, with respect to a reference of the member 40, such as an end of the part 43 itself. The part 43 of the member 40 can thus be designed to provide both the means for coupling to the plug 20 and the means for gripping or direct operation by a user, as well as means for indicating the angular position. Preferably, the part 43 of the member 40 is shaped and housed in such a way as to prevent any accidental actuation or displacement by the user, who is in any case able to determine and restore the proper position of the member 40 given the presence of the references 34.

It should be noted that the references 34 are set according to an arc of circumference, which is angularly staggered with respect to that of the references 32 present on the front surface of the dispenser (by approximately 90°, in the example illustrated): the member 40 is, however, mounted in the dispenser 10 in such a way that to each of the possible positions of the member 40 indicated by the references 34 there can correspond one and only one of the possible positions of the plug 20 indicated by the references 32.

Figure 7:
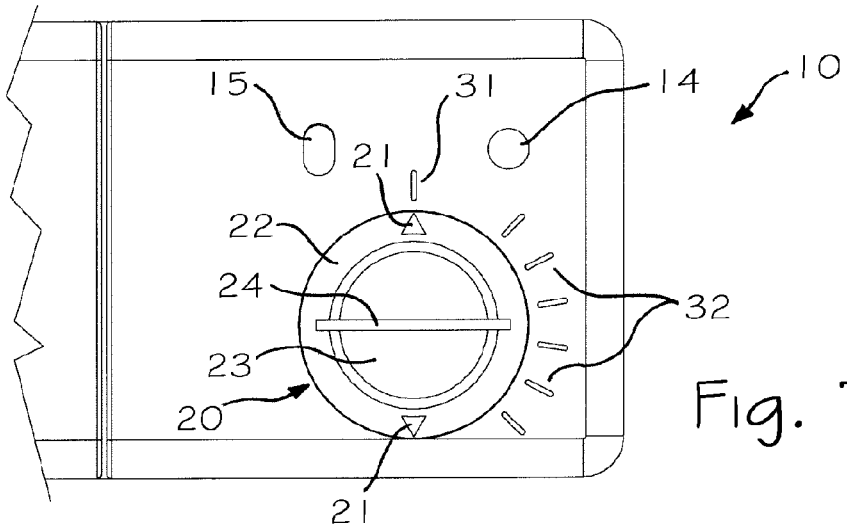
FIGS. 7, 8 and 9 are partial views in front elevation of the dispenser of FIGS. 2-6 in respective different conditions.

FIG. 7 represents a position of the plug 20, in which the bayonet-coupling means are released, even though the plug itself is inserted in the passage 30. In practice, in said position, the portions in relief 33 of the portion 30*b* of the passage 30 (FIGS. 3 and 5) are aligned to the inlets 26*a* of the respective seat 26 (FIG. 6). Consequently, starting from this position, the user simply has to turn the plug 20 in a clockwise direction, if he wishes to block the latter axially inside the passage 30, or else pull the plug towards himself, if he wishes to extract it from the passage 30.

With the plug 20 removed, the user can perform topping-up of the reservoir with the rinse aid, through the passage 30, in a known way. In order to reclose the passage 30, the user then inserts the plug 20 in the passage 30 as may be seen in FIG. 7, i.e., with any of his two references 21 substantially aligned to the reference 31, and with the lower appendage 28 of the plug 20 that is inserted at least partially in the recess 44 of the coupling part 43 of the member 40. As may be readily understood, for the purposes of practical implementation, even just one reference 21 is sufficient on the plug, the presence of two such references being preferable only to facilitate the user, as has been said, in the initial positioning of the plug in the charging passage.

Next, the user can turn the plug 20 in a clockwise direction as viewed in the figures. In the course of the first stretch of the movement of rotation, the ramp 26*b* of the resting surface of each seat 26 (FIG. 6) penetrates underneath the bottom surface of the contrast elements 33, which can possibly be inclined in a concordant way. As may be readily understood, proceeding in the rotation of the plug 20, the inclined conformation of the surface 26*b* determines a pulling action of the plug towards the inside of the passage 30, on account of sliding of the portions in relief 33 on the surfaces 26*b*. In this way, there is thus obtained an angular and axial movement of the plug 20 such as to determine compression of the gasket 25 on the seal portion shaped like a truncated cone 30*a* of the passage 30. Clearly, the depth of the recess 44 is such as to enable further insertion of the lower appendage 28 caused by the slight lowering of the plug 20 in this step. It is likewise clear that the rotation of the plug 20 causes in this step also a rotation of the underlying member 40.

Figure 8:
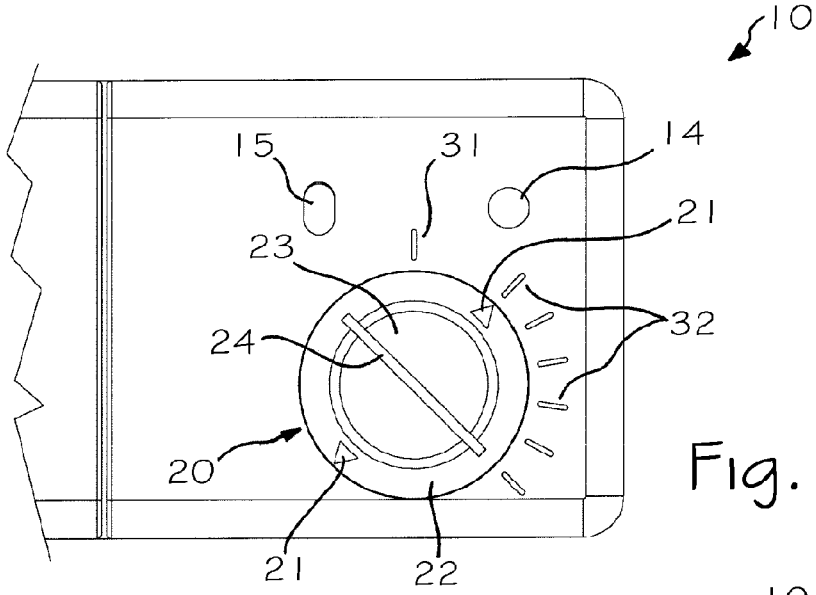

When underneath the portions in relief 33 there comes to be located the initial stretch of the plane surface portion 26*c* of each seat 26, the plug 20 is substantially in the position illustrated in FIG. 8. In the surface 26*c*, it is hence possible to identify a first stretch, designated as a whole by 26*c*' in FIG. 6, in which the condition of engagement of the bayonet coupling starts. This initial stretch 26*c*' basically has a length that is equal to or a little greater than the width of a respective portion in relief 33.

In this position, the reference 21 that at the start of rotation of the plug (FIG. 7) was aligned to the reference 31, comes now to be aligned to the first of the references 32 (i.e., the one closest to the reference 31). This condition indicates to the user that the plug 20 is in the corresponding blocking condition in an axial direction and in a first position of adjustment of the member 40.

Figure 9:
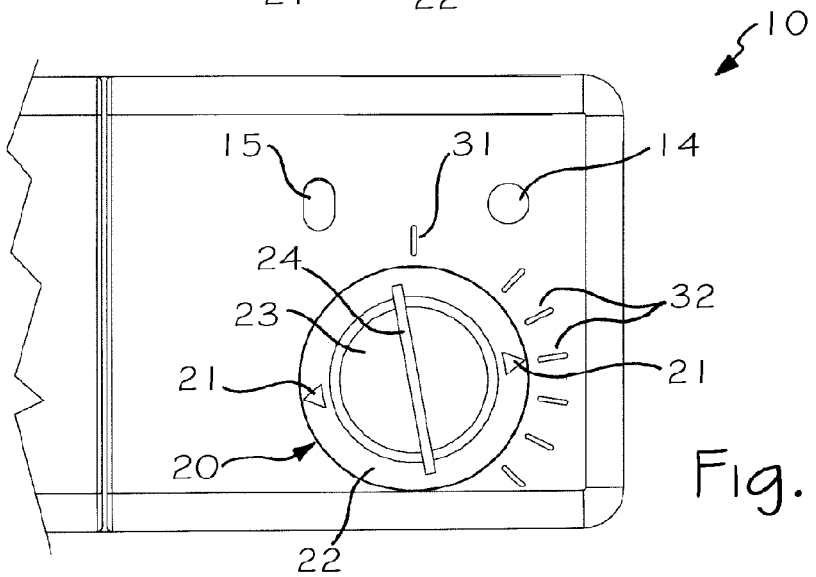

In the case where the user desires to set the system for dosage of the rinse aid in a different way, he simply has to move the plug angularly further so as to bring the reference 21 considered into a position where it to another one of the references 32. Such a case is represented in FIG. 9, where the reference 21 is aligned to the third reference 32. In said position, inside the passage 30, the member 40 will occupy an adjustment position such that one end of the portion 43 is substantially aligned to one of the corresponding references 34 present inside the passage 30 (consequently, in the case exemplified, and with reference to FIG. 5, the portion 43 will have its upper end that corresponds to the number "3" belonging to the references 34).

When it is necessary to top up the reservoir with the rinse aid, the user simply has to turn the plug 20 in an opposite direction with respect to the previous one (in a counterclockwise direction, as viewed in the figures), until it is brought into the position of FIG. 7. When the user notices that the reference 21 is aligned to the reference 31, he knows that the plug 20 is in the condition of release of the bayonet coupling (i.e., the portions in relief 33 are in positions corresponding to the inlets 26*a* of the seats 26) and can be pulled towards the outside of the passage 30.

According to the first embodiment of the invention, then, the plug 20 is allowed to perform a significant or substantial "overtravel" with respect to the position of FIG. 7, starting from which there occurs blocking in an axial direction of the plug itself inside the passage 34. The guides 26 have the surface portion 26*c* appropriately shaped for said purpose, namely, with a stretch, designated by 26*c*" in FIG. 6, that is decidedly longer than the stretch 26*c*' in which the condition of engagement of the bayonet coupling started (basically, the length of the stretch 26*c*" is equal to the difference between the total length of the surface 26*c* and the length of the initial stretch 26*c*'). This overtravel has substantially no effect on the axial blocking of the plug 20 and on the amount of the compression imparted on the gasket 25 given that, as has been said, the surface portion 26*c* is substantially plane and orthogonal to the axis A of rotation of the plug 20, when this is inserted in the passage 30.

As may be seen, according to the invention, the plug 20 and the member 40 for volumetric adjustment of the doses of rinse aid are provided with separable interconnection or coupling means 28, 43-44. This characteristic enables both free extraction and insertion of the plug 20 from/in the charging passage 30, in order to enable the operations of topping-up of the reservoir with the rinse aid and use of the plug as means for controlling the adjustment member 40, even when the plug is in an axial blocking condition inside the passage 30. The invention thus enables the volumetric adjustment of the doses of rinse aid to be performed directly from outside the body 11 of the dispenser 10, so favouring complete practicality and convenience of use, without the user having to insert his fingers or a makeshift tool in the passage 30. The solution proposed moreover enables a classic or standard structure to be maintained for the dispenser.

The solution proposed is simple and inexpensive to produce, given that the main body of the plug, defining the appendage 28, and the body of the member 40 with its upper engagement part 43, can be obtained via operations of moulding of plastic material. Another advantage is that the solution proposed does not bring about any increase in the overall dimensions of the dispenser as compared to a similar dispenser of a known type. The closing element of the reservoir for the liquid washing agent, i.e., the plug, is sturdy and reliable.

A further advantage is that of making the user aware of the effective possibility of adjustment of the dosage of rinse aid, which should, in fact, be appropriately set according to the effective requirements of washing and/or according to the hardness of the water (in everyday practice, the possibility of adjustment is frequently ignored by the user, i.e., the position of the adjustment member is not modified with respect to the one set during the cycle of production of the dispenser: the adjustment set in the production step often corresponds to a dose that is excessive as compared to the actual requirements, with consequent waste of the washing agent).

The proposed solution moreover enables the purposes set forth to be achieved by adopting a plug and/or a dispenser body, which, apart from the peculiar characteristics described, have a general configuration that is substantially similar to that of the plugs and/or dispensers already commonly used in the sector.

FIGS. 10 to 17 illustrate a second possible embodiment of the present invention. In said figures, the same reference numbers adopted in the previous figures are used to indicate elements that are technically equivalent to the ones described and represented previously.

Figure 10:
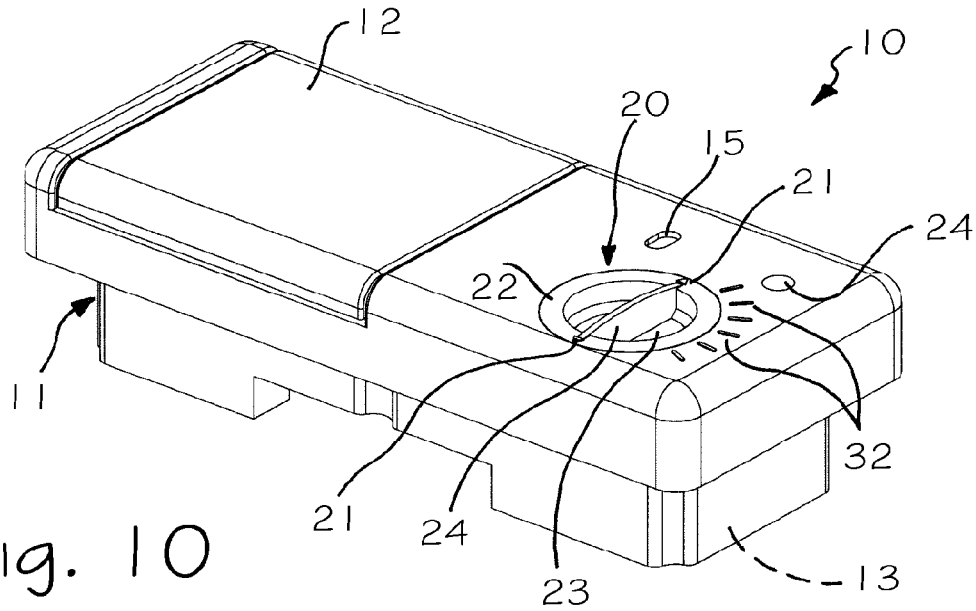
FIGS. 10 and 11 are perspective views of a dispenser made in accordance with a second embodiment of the invention in two different conditions.
Figure 11:
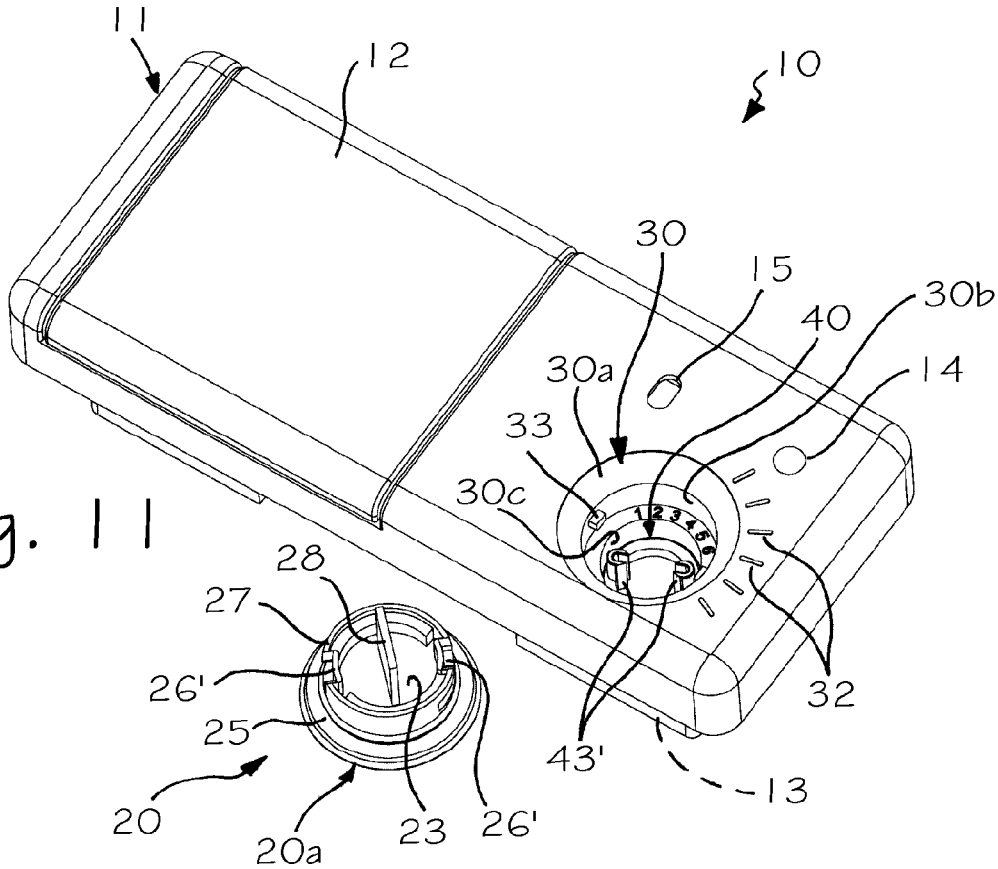

As may be seen from FIGS. 10 and 11, the dispenser 10 of the second embodiment presents a general construction that is substantially similar to that of the dispenser of the first embodiment, the substantial modifications regarding in fact the shape of the guides of the bayonet coupling present on the plug 20 and the conformation of the upper part of the adjustment member 40, as well as the mode of use of the plug for varying the angular position of the member itself. This solution, does not moreover present the reference 31 on the front of the body 11 of the dispenser 10 (even though, in a variant not represented, said reference can be in any case envisaged).

Figure 12:
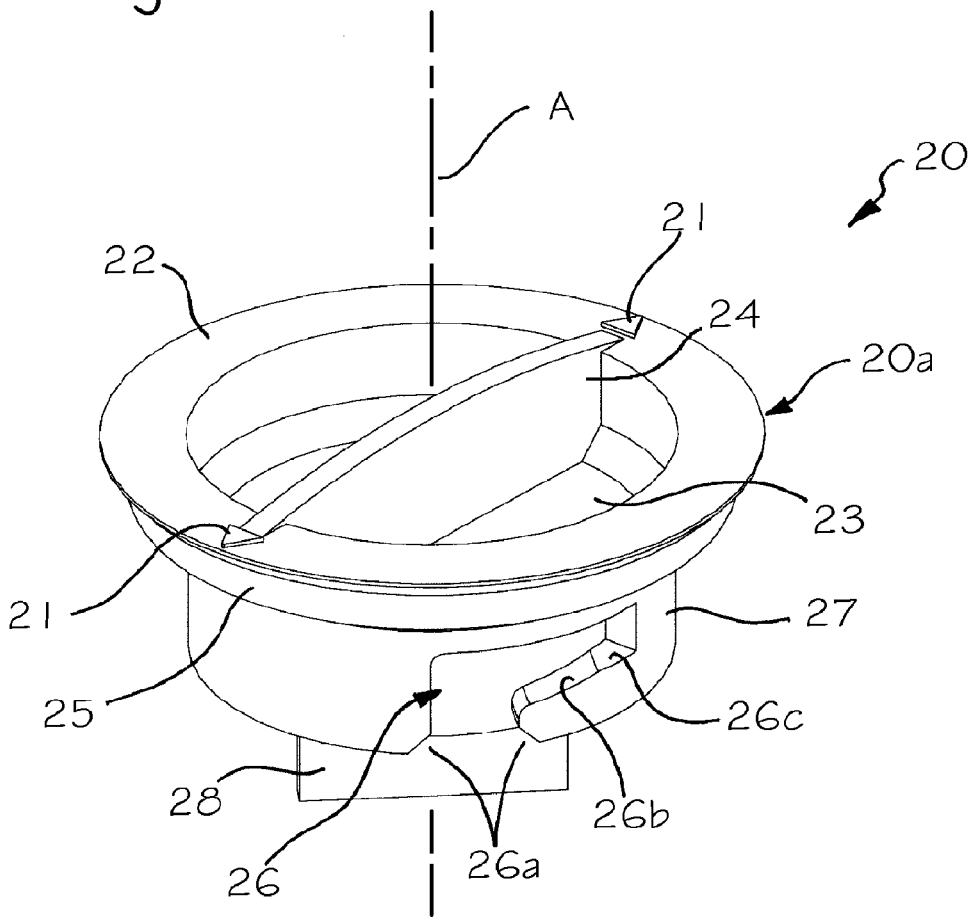
FIG. 12 is a perspective view at an enlarged scale of two components of the dispenser of FIGS. 10-11.
Figure 12:
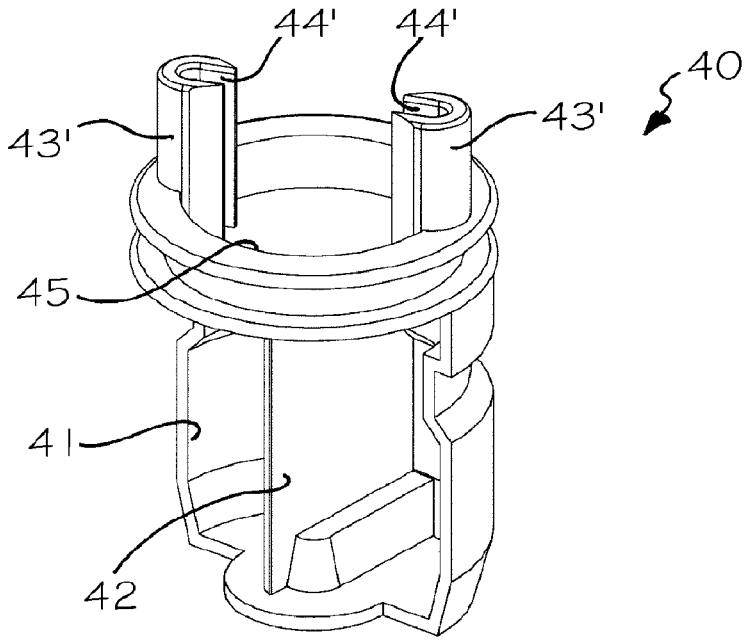

As may be seen from FIG. 12, the plug 20 has a general conformation that is very similar to that of the corresponding plug of FIG. 6, but in this case the guides forming part of the bayonet-coupling system, designated by 26', are of a traditional type, i.e., distinguished by the presence of an inlet 26*a*, by a ramp or inclined surface portion 26*b*, and by a short plane surface portion 26*c* (the length of which is roughly the same as that of the stretch 26*c*'—FIG. 6—of the first embodiment). It may be immediately noted how, in this solution, the surface portion 26*c* has an extension in length appreciably smaller than that of the inclined surface portion 26*b*. As will be recalled, in the case of the first embodiment (see FIG. 6), the plane portion 26*c* is, instead, decidedly longer than the inclined portion 26*b* in order to enable the plug 20 to perform the aforesaid overtravel with respect to the starting position from which the fluid-tight axial blocking is obtained.

Also the general conformation of the member 40 is similar to that of the homologous member of FIG. 6, in particular as regards the tray 41 with the corresponding diaphragm 42. In this case, the member 40 is without the upper portion 43 of FIG. 6, which is in fact replaced by two distinct engagement elements 43', which rise axially from the upper part of the member 40 and are parallel and/or specular to one another. These elements 43' each have a respective seat, here represented by a longitudinal groove 44', and are set in positions diametrally opposite with respect to one another. The two grooves 44' face one another and are able to receive between them the lower appendage 28 of the plug 20 or, more precisely, two opposite longitudinal edges of the latter. In a variant not shown, the appendage 28 can be replaced by two distinct appendages (for example, obtained by removing a central portion of the appendage 28), said distinct appendages each being coupled with a respective groove 44'. Any other means designed to be coupled with said seats or grooves 44', or with other means for mutual coupling, however shaped, provided in the member 40, is in any case suitable for the purpose.

In the second embodiment, the plug 20 is substantially configured for functioning also as dedicated tool or specific tool for varying the angular position of the adjustment member 40 in the passage 30, in an inoperative condition of the bayonet coupling.

Figure 13:
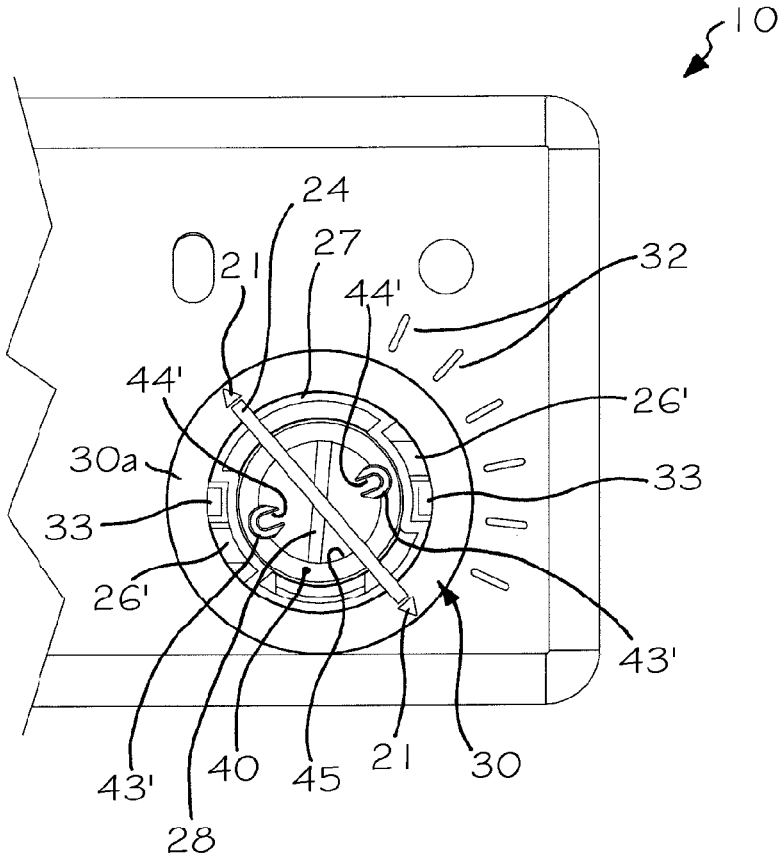
FIGS. 13-17 are partial views in front elevation of the dispenser of FIGS. 10-12 in as many operating conditions.
Figure 14:
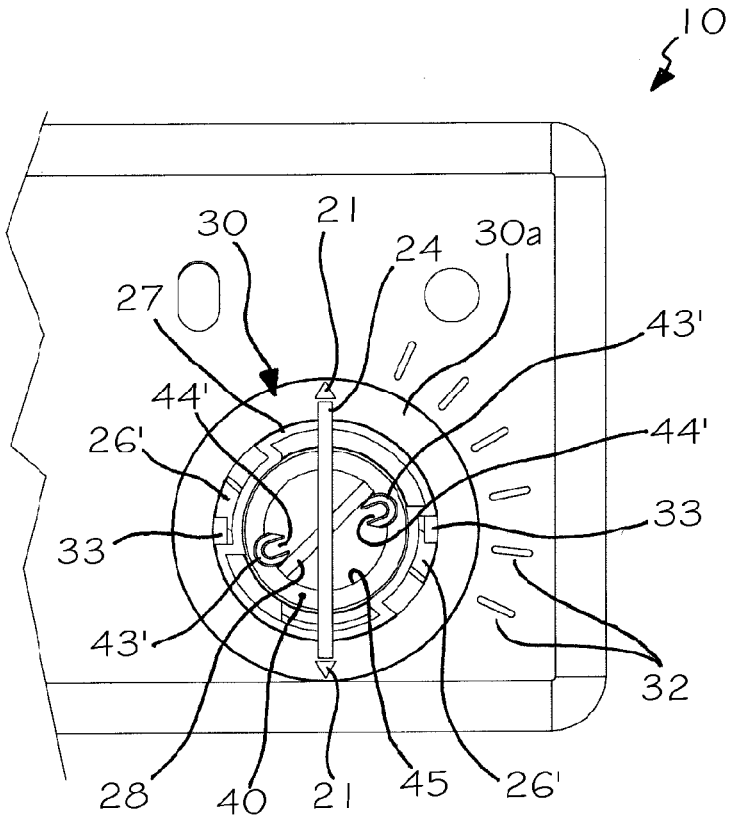
Figure 15:
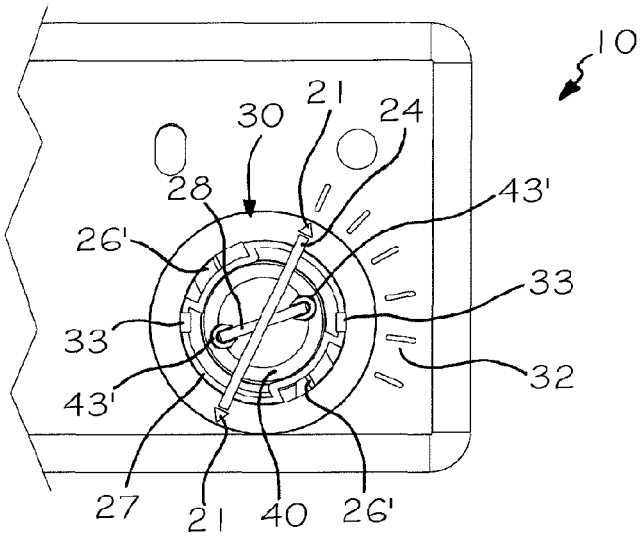

In other words, when the plug 20 is in the position of fluid-tight sealing of the passage 30, i.e., in condition of mutual engagement of the portions in relief 33 with the seats 26', the appendage 28 of the plug 20 is not engaged in the elements 43', it being able to move freely in an area between said elements 43'. The idea is illustrated in FIGS. 13 and 14, visible in which are, respectively, the condition of release and the condition of engagement of the bayonet coupling. It should be noted that in FIGS. 13-17, in order to illustrate better the relative arrangement between the parts, the body of the plug 20 is represented as transparent, except for the references 21, the transverse wall 24, the cylindrical wall 27, and the lower appendage 28, and the gasket 25 has been omitted. As may be noted in FIG. 14, when the plug 20 is blocked so that it seals the passage (namely, when the elements 33 are engaged in the terminal portion 26*c* of the seats 26'—FIG. 12), the appendage 28 is not to be coupled with the elements 43'. From this position, in the case where it is desired to remove the plug 20, the user simply has to turn the plug itself in a counterclockwise direction to bring it into the position of FIG. 13. In this way, the seats 26' are positioned with respect to the contrast elements 33 in such a way that the latter come to be in substantial alignment with the respective inlets 26*a* of the seats 26' (FIG. 12). In this way, by exerting a pulling action on the plug 20 via the gripping means 24, the plug itself can be extracted from the passage 30. In order to perform the fluid-tight seal and blocking of the plug, operations opposite to the ones just described are evidently carried out. It will be appreciated that, also in this case, the clockwise rotation of the plug (once again as viewed in the figures) determines relative sliding between the contrast elements 33 and the inclined surfaces 26*b* so as to determine an axial and rotary movement of the plug, which produces compression of the gasket 25.

Figure 16:
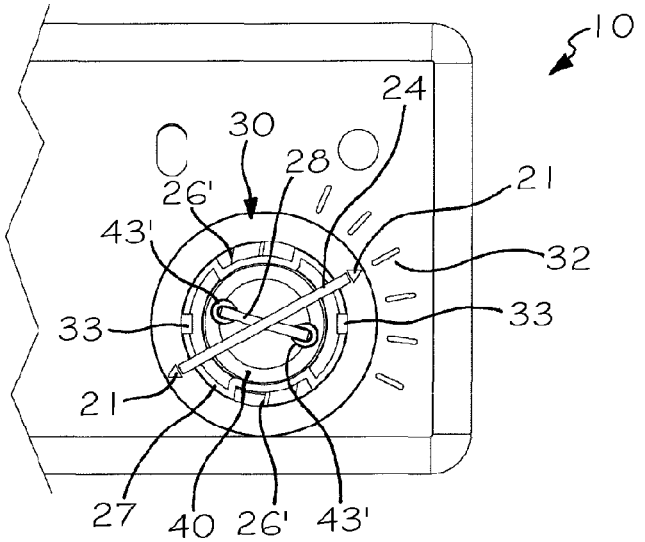
Figure 17:
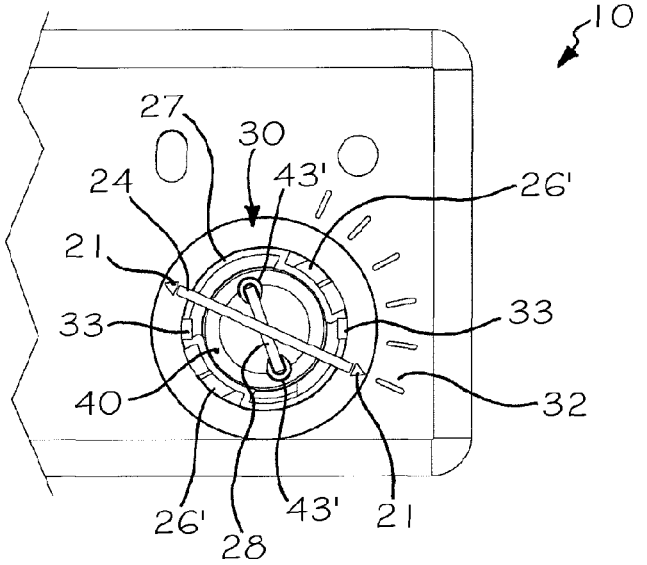

In order to make the volumetric adjustment of the doses of rinse aid, i.e., to vary the angular position of the member 40 inside the corresponding stretch of the passage 30, the user must first remove the plug 20 from the dispenser 10, according to the modalities described previously. At this point, the plug 20 is used as dedicated tool: the user must then insert the plug 20 at least partially into the passage 30, taking care to fit the lower appendage 28 in the opposite and parallel grooves 44' of the elements 43'. Such a condition is illustrated, for example, in FIG. 15, where the plug 20 has been rotated in such a way that the reference 21 of interest is located in a position corresponding to the first reference 32. FIGS. 16 and 17 show further possible positions of adjustment, in which the plug 20 is rotated in such a way that the reference 21 is aligned, respectively, with the third and with the sixth of the references 32, to which there evidently correspond different positions of the member 40 and, consequently, different volumetric adjustments of the deliverable doses of rinse aid.

In order to fit the appendage 28 between the elements 43', the plug 20 can be introduced into the passage 30 until the bottom edge of its cylindrical wall 27 (FIG. 12) rests on the upper surface of the portions in relief 33, and in any case in the inoperative condition of the bayonet coupling (i.e., with the portions in relief 33 that are not engaged in the seats 26' or inserted in the corresponding inlets 26*a*). Preferably, in this condition, the cylindrical wall 27 is at least partially inserted in the cylindrical portion 30*b* of the charging passage 30, said portion having a diameter only slightly smaller than that of the wall 27, in such a way that the angular movement imparted on the plug 20 will be guided. For this purpose, the appendage 28 and/or the elements 43' have a length such as to be coupleable also with the plug 20 slightly slid out of or extracted from the cylindrical portion 30*b*, i.e., in a position at a height different from that of closing of the plug 20.

Once the plug 20 is used as dedicated tool for adjustment of the angular position of the member 40, the user simply has to extract the plug from the passage 30, reinsert the plug into the passage for engaging the bayonet-coupling system, substantially as illustrated in FIG. 13, and then turn the plug until it is brought into the position where the bayonet coupling enters into action, and hence into the position of fluid-tight blocking of the plug, as may substantially be seen in FIG. 14. As may be seen, in the conditions of FIGS. 13 and 14, the lower appendage 28 of the plug is not engaged in the grooves 44' of the elements 43' of the member 40. The geometry and the relative positions between the parts are such that the angular movement imparted on the plug 20 when passing between the positions of FIGS. 13 and 14 is not transferred to the member 40, and this also thanks to the conformation of the portion of the member 40, from which there rise the elements 43', and which is shaped precisely to enable free rotation within it of the lower appendage 28 of the plug 20. As may be noted, in the example the two engagement elements 43' rise substantially from an upper cavity 45 of the member 40, within which the lower portion 28 can turn. As may be readily understood, the configuration of the parts is such that, in the angular movement of the plug between the positions of FIGS. 13 and 14, i.e., respectively the position of release and the end-of-travel position of closing of the bayonet-coupling system, the appendage 28 does not interfere with the elements 43' in such a way as to induce a rotation of the member 40.

As may be seen, also the second embodiment proposed enables the purposes of the invention to be effectively achieved. The solution prevents the user from having to insert his fingers inside the passage 30 for charging the rinse aid. For said purpose, the plug 20 and the member 40 are shaped so as to co-operate with one another, with the former that functions as dedicated tool for the purposes of adjustment of the position of the latter. As in the case of the first embodiment, the user has no need to use a makeshift tool, such as a screwdriver or the tip of a knife, to make the adjustment, a fact that moreover eliminates the risk of damage to the member 40, which is typical of the usual practice according to the known art (this practice is moreover discouraged or rendered problematical by the particular new conformation of the member 40 and/or of the portions in relief 44').

Also the second embodiment is constructionally very simple in so far as it implies only the modification of the conformation of pieces normally obtained by moulding of thermoplastic material. The solution is hence also economically advantageous from the industrial standpoint. Also the second embodiment does not moreover determine any increase in the overall dimensions of the dispenser.

The invention has been described by way of example with reference to the case where the reservoir 13 is designed to contain a rinse aid. The invention is in any case equally applicable also to the case where the reservoir is designed to receive a fluid substance different from a rinse aid, such as a liquid detergent, a bleaching agent, a rinsing additive, etc. The term "washing agents" moreover includes, apart from detergent substances and lustering agents, also further substances that can be used in household washing machines, such as softening agents, perfumes, substances for preventing the colours from running, water-softening agents and anti-lime substances, disinfectants, etc., as likewise all the other fluid substances or products designed to be dispensed in a washing machine, preferably of a household type.

It is clear that numerous variants of the dispenser of washing agents described herein by way of example are possible for the person skilled in the sector, without this implying any departure from the scope of the present invention as defined in the annexed claims. It is to be understood that falling within the scope of the invention are also washing machines, in particular dishwashers, provided with a dispenser like the one forming the subject of the invention.

Illustrated in FIG. 18 is a plug 20 made in accordance with a possible variant of the second embodiment. In said variant, the cylindrical wall 27 of the plug 20 has opposed undercuts or recesses, one of which is designated by 29, aimed at enabling complete insertion of the plug 20 in the cylindrical portion 30*b* of the passage 30 (i.e., at a height corresponding to that of closing of the plug 20) also when the plug itself is used as adjustment tool. Obviously, instead of undercuts the cylindrical wall could envisage, for said purpose, reductions of diameter.

Amongst other possible variations there is to be pointed out the possibility of replacing the portion 43 of the embodiment of FIG. 6 with two engagement elements of the same type as the ones designated by 43' in FIG. 12, with the corresponding axial grooves 44'.

In another variant, in particular in the case of the second embodiment, the means for mutual coupling between the plug and the charging passage can be of a threaded type, instead of being of the bayonet-coupling type, or yet again ones of a press-block-coupling or snap-action-coupling type.

In yet another variant, the charging passage, instead of being configured as a conduit that extends towards the inside of the body of the dispenser, comprises a tubular part projecting towards the outside, on which the plug can be engaged.

In a further variant, the body of the dispenser, the plug, and the volumetric adjustment member are configured in such a way that a part of the adjustment member is accessible through the charging passage only via the corresponding part for engagement of the plug.

The arrangement of the means for mutual coupling represented by the portions in relief 33 and by the guides 26 could be opposite to the one represented, i.e., with the guides made within the passage 30 and the portions in relief provided in the plug 20.

As has been mentioned previously, the plug and the adjustment member of the dispenser according to the invention can be configured for providing, between them, a coupling or co-operation that are different from a direct mechanical interconnection, such as for example a magnetic coupling.

Figure 19:
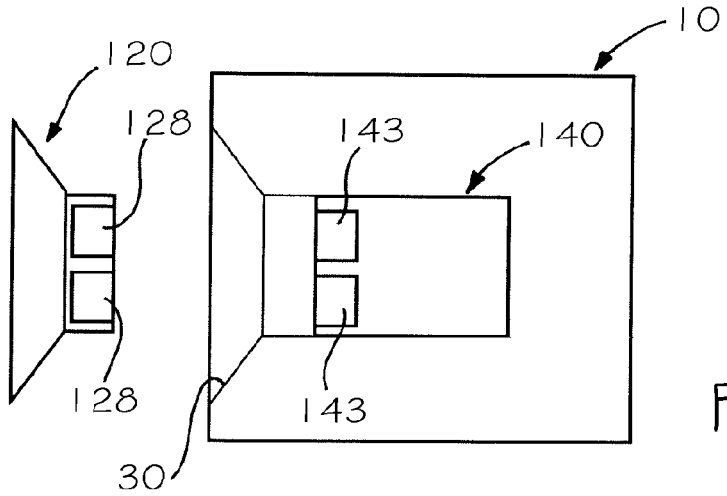
FIGS. 19-21 are block diagrams of further possible variants of the invention.

A first possible variant in this sense is schematically illustrated in FIG. 19. In this variant the plug, designated by 120 integrates at least one magnetic element 128, such as a permanent magnet, designed to be magnetically coupled with at least one respective magnetic element 143, such as a permanent magnet, integrated in the adjustment member, designated by 140. The elements 128, 143 are arranged, in terms of dimensions, orientations and respective magnetic forces, in order to provide a magnetic coupling such that a movement imparted on the plug 120 will be transferred to the member 140. In practice, then, in this embodiment the magnetic elements 128 and 143 replace, respectively, the appendage 28 and the coupling parts 43 or 43' of the previous embodiments, but perform the same functions, particularly in terms of mechanical transmission of the movement from the plug 120 to the member 140. Of course, each element 128 or else each element 143 could possibly be formed, instead of by a magnet, by a body made of non-magnetized ferromagnetic material. Advantageously, the elements 128 and 143 can be magnetized in sectors, i.e., with a number of magnetic polarities alternating at one and the same end, the coupling between them, by means of sectors with opposite polarities remaining unvaried (at least one sector of the element 128 having north magnetic polarity that couples with at least one sector of the element 143 having south magnetic polarity) in particular in order to obtain a coupling in a pre-defined position between the elements 128 and 143 and/or in order to prevent relative displacements during actuation.

In accordance with another variant, at least one between the plug 20 and the adjustment member 40 is configured for interacting or co-operating in an electrical, and/or electronic, and/or electromechanical, and/or optical, way with the system for dosage and delivery of the liquid washing agent or, more in general, with a system for controlling the washing machine. An example of this type is represented schematically in FIG. 20 in relation to a plug, designed to generate a useful signal for verification of an operating state of the system for dosage and/or delivery the liquid agent.

Figure 20:
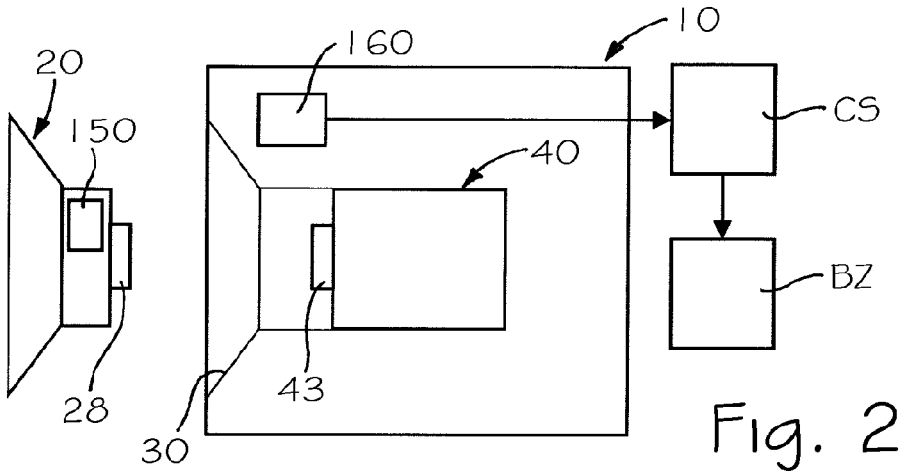

Assume for said purpose that the plug 20 and the member 40 of FIG. 20 are of a conception similar to that of the embodiment of FIGS. 1-9 and hence configured in such a way that the angular position of the plug 20 in the passage 30 determines also the position of adjustment of the member 40. According to the variant proposed, the plug 20 further comprises an excitation element 150, designed to induce or generate a signal in a respective sensor 160, mounted in the dispenser 10 in an adequately protected position, particularly from the electrical and hygroscopic standpoint or, in general, from the point of view of the environmental conditions, said signal being variable as a function of the angular position of the plug itself in the passage 30. The excitation element 150 may, for example, be a permanent magnet, also of the type magnetized according to sectors, and the sensor 160 may be a magnetic or Hall-type sensor of a digital or analog type. In the example considered, then, the element 150 is integrated in the body of the plug 20 in an eccentric position so as to induce or generate in the sensor 160 a signal that is proportional to the intensity of the magnetic field detected, i.e., proportional to the position (or distance) of the element 150 with respect to the position of the sensor 160 and hence, in practice, indicative of the position of adjustment assumed by the plug 20 in the passage 30.

In this way, the control system of the washing machine, designated as a whole by CS, which is configured for the purpose, is able to know, via the detection system represented by the element 150 and by the sensor 160 (which can advantageously provide a sensor or detector of an encoder type), the position assigned to the plug 20, which in turn represents the operative position of the member 40. This signal can be conveniently used for the purposes of control of the operative state of the dosage and delivery system, for example to provide a sort of feedback control of the dose adjusted manually. Assume, for example, that the machine has sensor means, in themselves known, for detecting one or more qualities or characteristics of the treatment liquid, such as the degree of hardness of the water: in the case where the user of the machine sets, via the plug 20, a position of adjustment for the member 40 that is not correct in relation to the degree of hardness and/or in relation to some other characteristic of the liquid detected by the aforesaid sensor means, then the control system SC can signal to the user, for example via an optical or acoustic warning device BZ, the erroneous setting of the dose of liquid washing agent. In this way, there is also obtained the effect of making the user aware of a correct use of the liquid washing agent.

Figure 21:
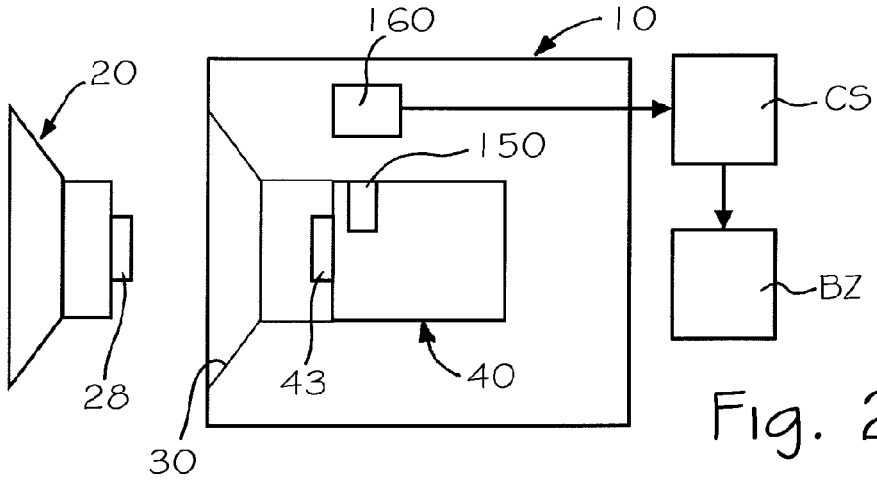

A solution similar to the one just described in relation to FIG. 20 can be implemented by providing the excitation element 150 on the adjustment member 40, instead of on the plug 20. This case is schematically represented in FIG. 21, according to which the plug 20 and the member 40 can be indifferently of a conception similar to the one of the embodiment of FIGS. 1-9 or else of the embodiment of FIGS. 10-17. According to the variant proposed, it is the adjustment member 40 that comprises the excitation element 150, designed to induce or generate a signal in the sensor 160 provided in the dispenser 10 according to the same principles set forth previously. Also in this case, the element 150 can be represented by a permanent magnet, set in an eccentric position on the body of the member 40, and the sensor 160 be a magnetic or Hall-type sensor, either analog or digital. As may be readily understood, the embodiment according to the variant of FIG. 21 enables the same operations described above in relation to FIG. 20 to be obtained. The preceding solution of FIG. 20 affords the further advantage that, via the sensor 160 and the excitation element 150, the control system SC, configured for the purpose, is also able to detect, for example upon starting of a washing cycle, the possible absence of the plug 20 in the corresponding seat 30, or else an incorrect closing position thereof so as to provide the user of the machine with a timely warning, for example, via the same warning means BZ.

Figure 22:
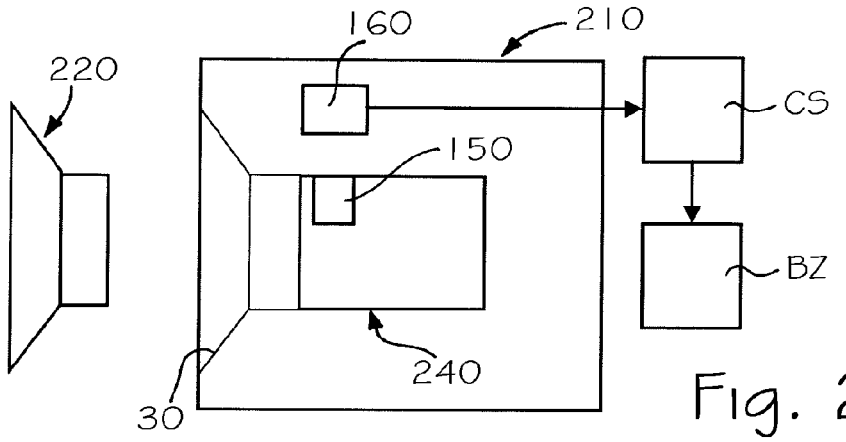
FIGS. 22-24 are block diagrams of further embodiments of dispensers, which in themselves represent inventive steps.

According to an independent aspect of the invention, a detection system similar to the one described with reference to FIG. 21 can be advantageously implemented also on dispensers with traditional plug and adjustment member, i.e., of the type in which the setting of the desired dose of lustering agent is carried out by acting directly on the adjustment member in a classic way, without the use of a plug as described with reference to FIGS. 1-18. A case of this sort is exemplified in FIG. 22, where 220 and 240 designate, respectively, a plug and an adjustment member without respective coupling means, whilst designated by 150, 160, SC and BZ are elements technically equivalent to the ones described above with reference to FIG. 21.

Designated as a whole by 210 is the dispenser. As may be readily understood, also with a plug 220 and a member 240 of general traditional conception, but modified according to the inventive aspect considered here, the solution of FIG. 22 enables a signal to be made available that can be used for the purposes of control of the operating state of the dosage and delivery system, as mentioned previously with reference to FIG. 21.

Figure 23:
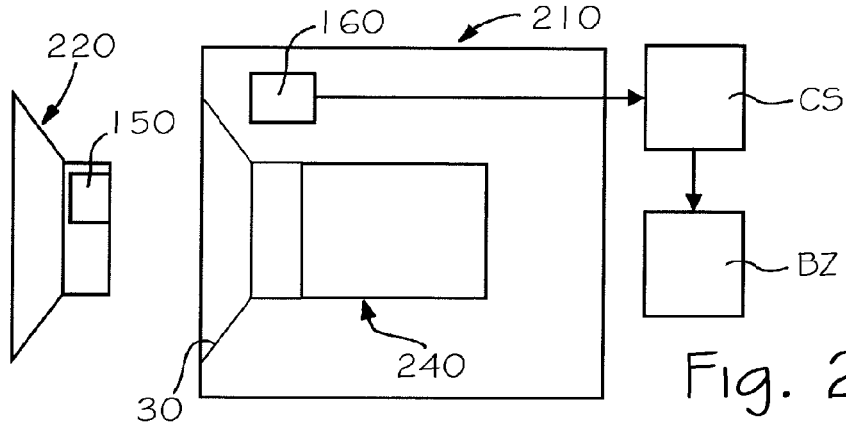

According to a further independent aspect of the invention, also a detection system similar to the one described with reference to FIG. 20 can be implemented on dispensers with traditional plug and adjustment member. A case of this sort is exemplified in FIG. 23, where designated by 220 and 240 are respectively a plug and an adjustment member without respective coupling means, whilst designated by 150, 160, SC and BZ are elements technically equivalent to the ones described with reference to FIG. 20.

Designated as a whole by 210 is the dispenser. As may be readily understood, also with a plug 220 and a member 240 of traditional general conception, but modified according to the inventive aspect considered here, the solution of FIG. 23 enables the control system SC to detect the possible absence of the plug 220 in the corresponding seat 30, or else an incorrect positioning thereof in closing, so as to warn the user, for example via the same warning means BZ.

According to a further independent aspect of the invention, a detection system similar to that of FIG. 20 can be used in order to set the amount or volume of the washing agent constituting a dose to be delivered, particularly for the case of dispensers without a member of the type previously designated by 40.

Some of these known dispensers are equipped, between the reservoir of the liquid agent and the corresponding opening for delivery, with an electric pump of substantially constant flowrate, for example of the vibrational or peristaltic type. The choice of the desired dose of rinse aid is made using suitable setting means provided in the control panel of the machine and, as a function of said setting, the system controls the time of activation of the pump in order to cause delivery of substantially pre-defined amounts of liquid washing agent corresponding to the setting made by the user. In other known solutions, instead of a pump there is provided a delivery valve, the open/close element of which is controlled by an electrical actuator, such as a solenoid. In these solutions, the amount of liquid agent that can be delivered with a single actuation (ON/OFF) of the actuator is constant, and the substantially pre-defined amount of agent that constitutes a deliverable dose can be varied between a minimum (which can be obtained with a single actuation of the valve) and a maximum (that can be obtained with a number "n" of repeated actuations of the valve: in practice, the deliverable amount is equal to a fraction of the dose). Also in these solutions the choice of the desired dose (i.e., of the corresponding substantially predefined amount of liquid agent) is made using setting means provided in the control panel of the machine. As a function of said setting, the control system of the machine determines the individual activation (adjustment set at the minimum) or a number of successive activations (adjustment higher than the minimum) of the valve actuator, which are necessary to obtain delivery of the desired dose of liquid agent.

Figure 24:
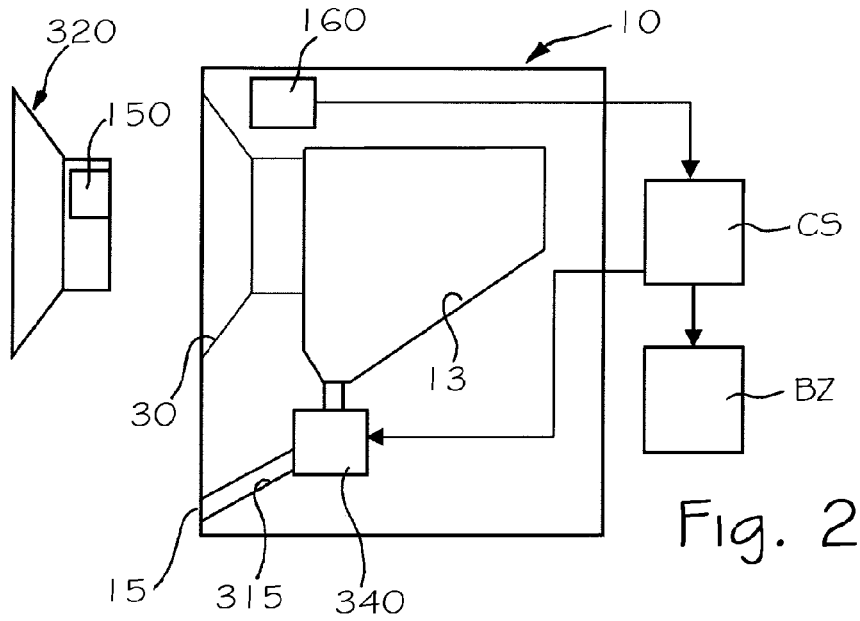

In the embodiment illustrated schematically in FIG. 24, the reference number 10 designates the dispenser, 13 designates the reservoir of the liquid washing agent, and 315 designates a conduit that terminates with the delivery opening 15, along said conduit there being provided a dosage and delivery device 340, such as a vibrational pump or else a delivery valve, as described above. Designated by 320 is a plug of the reservoir 13, having a bayonet-coupling system with respect to the corresponding passage 30 similar to the one described with reference to FIG. 6. Preferably, moreover, the plug 320 and the front of the dispenser 10 are provided with visual references similar the ones designated by 21 and 32 in FIGS. 1-17. The plug 320 also integrates an excitation element 150 for a sensor 160 mounted in the dispenser 110, said element and sensor operating in a way conceptually similar to the one described previously with reference to FIG. 20. Designated by CS is the control system of the machine, and designated by BZ are corresponding warning means, having purposes similar to those previously mentioned.

The control system SC, which is configured for the purpose, can recognize, via the detection system represented by the element 150 and by the sensor 160, the position assumed by the plug 320 in the corresponding passage 30, where said position indicates the desired setting for the dose of liquid washing agent to be delivered.

Consequently, according to the angular position set for the plug 320, the control system SC can control the device 340 for the purposes of delivery of the desired dose of liquid agent (i.e., according to the type of device 340, it can determine the time of activation of the aforesaid pump or else the number of actuations of the aforesaid delivery valve in order to obtain the total dose as set by the user).

In other words, then, in the embodiment proposed, the plug 320 and the detection system 150-160 replace the setting means, which, in the known solutions, are provided on the control panel of the washing machine, and which usually are somewhat problematical to use, above all when they require one or more keys to be pressed according to pre-defined sequences, which are often difficult to remember. Instead, in the solution proposed, the setting of the dose is made in a simple and intuitive way by simply turning the plug 320 into the desired position, exploiting the presence of the visual references 21 and 32. Clearly, this embodiment also enables feedback control and/or verification of presence/correct position for closing of the plug 320, as described previously with reference to FIG. 20.

The part to which the excitation element 150 is to be associated could be a mobile member different from the adjustment member or from the plug, but in any case once again configured as a component accessible directly or indirectly and carried on the body of the dispenser so as to be displaceable manually by a user between a plurality of possible pre-set positions, such as, for example, a rotating knob or a slider (i.e., either angularly or linearly mobile), associated to suitable reference signs indicating the possible deliverable amounts of liquid agent. Also in this case, then, a variation imparted manually on the aforesaid mobile component will be detected through the detection system 150-160 in order to generate a control/feedback signal of the dosage means.

Finally, it is clear that the system for detection of the position of the plug 20, 120, 220, 320 or of the adjustment member 40, 240 (or other component provided on the body of the dispenser that fulfils the functions of selection of the dose) may also be of a different type from the magnetic one previously exemplified. In such a perspective, for example, the plug or the member can envisage, on a respective wall, such as a circumferential wall, a cam surface (which provides an excitation element) designed to interact with a feeler of an electromechanical sensor, such as a potentiometric or resistive sensor of a known type. In said embodiment, for example, the profile of the cam can be chosen in such a way as to determine a recession or displacement of the aforesaid feeler that can vary as a function of the angular position of adjustment assumed by the plug or by the adjustment member, with consequent variability of the signal generated. In a similar variant, instead of a cam surface, the excitation element comprises a shaped profile or an excitation element made on a wall of the plug or of the adjustment member, designed to interact with an optical sensor of the dispenser, which replaces the sensor provided with feeler. The aforesaid profile, for example formed by a series of recesses and portions in relief, is configured so as to induce different reflections or variations in a beam of electromagnetic or optical radiation in such a way that also in this case the signal produced by the sensor varies as a function of the position of adjustment assumed by the plug or by the member, with consequent variability of the signal itself.

As may be readily understood, according to the invention the manual selection means of the dispenser, which can be operated by the user for setting the desired amount of liquid agent from amongst a plurality of possible dosage amounts, include the plug 20, 120, 320 of the reservoir 13, said plug being provided for being coupled or for co-operating in a separable way with an adjustment element mounted on or associated to the body 11 of the dispenser. The aforesaid adjustment element can be represented by the member 40, 140, which co-operates in a basically mechanical way with the plug 20, 120, or else by sensor means 160, which co-operate with the plug 320 in order to detect a position of the latter for generating a signal. Also possible are combinations of the two solutions, as is for example highlighted with reference to FIGS. 20 and 21. In this perspective, it is also possible to provide an adjustment of a mechanical type (for instance, according to the examples represented in FIGS. 1-18), albeit with detection via the system 150-160 of the desired dose, in view of a delivery of a "multiple" type (for example, of the type described with reference to FIG. 24). The combination proposed enables, for example, provision of a member of the same type like the one previously designated by 40 or 140, which can be mechanically adjusted to set a maximum deliverable amount, such as not to jeopardize the quality of a washing cycle even in the case of incorrect opening (malfunctioning) of the dosing valve 340, said maximum amount enabling in any case a delivery divided into a number of amounts, which are also delivered at different times of one and the same washing cycle according to the setting made using the plug and the system 150-160. Of course, it is then possible also to combine other characteristics of the different examples of embodiment in order to achieve configurations also different from the ones indicated by way of non-limiting example.

With particular reference to the variants described in relation to FIGS. 20-24, associated or associable to the body of the dispenser is a generic adjustment element, which may be represented by the plug, by the adjustment member, or by another means that can be displaced manually by the user between a number of positions (the aforesaid knob or slider), and the dispenser comprises means for detection of the position of the adjustment element, which are able to generate a signal, in particular for the control system of the machine on which the dispenser is mounted. In the case of the variants of FIGS. 20-22, the aforesaid means are designed to detect—either directly or indirectly—a position of adjustment of the adjustment member from amongst a plurality of possible positions, and generate accordingly a signal representing the position of adjustment detected, for example to provide a feedback control of the manually adjusted dose. In the case of the variant of FIG. 24, the aforesaid means are designed to detect a position of adjustment of the plug (or other means of manual setting provided on the dispenser) from amongst a plurality of possible adjustment positions, and generate accordingly a signal used for the purposes of control of the dosage system 340. In the case of the variants of FIGS. 23 and 24 (and consequently also in that of the variants of FIGS. 20 and 21), the aforesaid means are designed (also) to detect a condition of presence/absence of the plug in the charging passage and/or a condition of proper positioning of the plug itself so that it closes said passage and generate accordingly a signal indicating the condition detected.

The eccentric positioning of the excitation element 150 on the body of the plug or of the adjustment member, or of some other mobile member that replaces the functions of manual selection thereof, described with reference to FIGS. 19-24, must not be understood as essential or as in any way limiting the scope of the invention: the element 150 can in fact also be integrated in an axial position in the plug or in the member and magnetized radially in sectors so as to induce or generate a digital signal in the sensor 160, which indicates the position.

The invention claimed is:

1. A dispenser of washing agents for a household washing machine, the dispenser comprising:

a body having a reservoir for a substance that can be delivered, in particular a liquid washing agent, the reservoir being configured for containing a total amount of substance sufficient for performing a number of cycles of operation of the machine and having a charging passage that can be engaged or that can be closed by a plug, wherein the charging passage and the plug have means for mutual coupling, the plug being removable from the charging passage in order to enable introduction of the substance into the reservoir, where in particular set between the plug and the charging passage are operative sealing means, the dispenser including at least part of a dosage system for delivering the substance in substantially pre-defined dosage amounts, said dosage system including an adjustment element which is mounted on said body and manual-selection means, which can be operated by a user in order to set a desired dosage amount from amongst a plurality of possible selectable dosage amounts, wherein said adjustment element and said plug are configured as separate components, wherein said manual selection means comprise said plug, and wherein said plug is coupled to or cooperates in a separable way with said adjustment element.

2. The dispenser according to claim 1, wherein said adjustment element comprises an adjustment member, which is mounted movable in the dispenser, wherein the plug has first connection means and the adjustment member has second connection means, and wherein the first connection means of plug and the second connection means of the adjustment member are configured for being coupled to one another or co-operating in a separable way, such that a manual movement imparted on the plug brings about a movement of the adjustment member.

3. The dispenser according to claim 2, wherein said first connection means comprise a part of the plug and said second connection means comprise a part of the adjustment member, and wherein said part of the plug is engaged in a separable way with said part of the adjustment member when the plug is at least partially inserted in the charging passage.

4. The dispenser according to claim 3, wherein said part of the plug comprises an appendage and said part of the adjustment member comprises one of:

an element defining at least one recess or seat for receiving an end portion of said appendage, or else vice versa; and at least two elements provided with a respective seat or groove, preferably axial elements set in diametrally opposite positions, in such a way that the seat of one said element is set facing the seat of the other element, the two seats receiving respective portions of said appendage, or else vice versa.

5. The dispenser according to claim 2, wherein the adjustment member is mounted so that it can turn in the body of the dispenser and has a part accessible through the charging passage, and wherein the first connection means of the plug and the second connection means of the adjustment member are configured for co-operating in a separable way when the plug is at least partially inserted in the charging passage such that a movement of rotation manually imparted upon the plug brings about a movement of rotation of the adjustment member.

6. The dispenser according to claim 1, wherein the plug and the adjustment member are configured for co-operating with one another via separable coupling means set between a body of the plug and a body of the adjustment member.

7. The dispenser according to claim 2, wherein the first connection means of the plug and the second connection means of the adjustment member are configured for co-operating mechanically with one another when the means for mutual coupling are in a respective inoperative condition, particularly with the plug inserted at least in part in the charging passage, where in particular the plug has, in a portion thereof, a cylindrical part, which, when the plug and the adjustment member co-operate mechanically with one another, is inserted at least partially in a cylindrical stretch of the charging passage.

8. The dispenser according to claim 2, comprising a system for detecting a position of adjustment, from amongst a plurality of possible positions of adjustment, of at least one of the plug and the adjustment member, where in particular said detection system comprises at least one excitation element associated to the plug or else to the adjustment member, which is able to co-operate with sensor means of the dispenser in order to generate a control signal.

9. The dispenser according to claim 2, wherein said first connection means comprise at least one first magnetic element and said second connection means comprise at least one second magnetic element.

10. The dispenser according to claim 1, wherein the body of the dispenser has, in a region of the outer surface thereof that is close to the charging passage, a plurality of reference signs of angular adjustment positions.

11. The dispenser according to claim 10, wherein the body of the dispenser has, in said region of its outer surface, at least one reference sign of a pre-defined angular position of the plug, in which the means for mutual coupling are in their condition of release.

12. The dispenser according to claim 1, wherein the plug has, in an upper portion thereof, at least one position-reference means.

13. The dispenser according to claim 1, wherein the means for mutual coupling are configured for maintaining, in a condition of engagement thereof, the plug in a position of fluid-tight sealing of the charging passage, the plug being manually operable for bringing the coupling means into a condition of release thereof, in which the plug can be removed from the charging passage.

14. The dispenser according to claim 13, wherein the means for mutual coupling are configured in such a way that, in said condition of engagement, the plug cannot be extracted from the charging passage but it is possible to impart an angular displacement on the plug which brings about an angular displacement of the adjustment element coupled in a separable way thereto.

15. The dispenser according to claim 13, wherein the means for mutual coupling are configured in such a way that it is possible to impart on the plug an overtravel with respect to a first pre-defined position thereof, starting from which said condition of engagement of the means for mutual coupling is obtained, where in particular a movement manually imparted on the plug within the range of said overtravel determines a movement of an adjustment member belonging to the dosage system from amongst a plurality of respective angular adjustment positions that can be assumed by the adjustment member itself, where in particular said overtravel is an angular overtravel and said pre-defined position is an angular position of the plug within the charging passage.

16. The dispenser according to claim 15, wherein the means for mutual coupling comprise:

at least one guide, formed in one of the plug and the charging passage; and at least one portion in relief, formed in the other one of the plug and the charging passage, which is able to engage in said guide, and wherein said guide has an inlet and a resting surface for the portion in relief, which is configured for enabling said overtravel.

17. The dispenser according to claim 16, wherein the resting surface comprises a first surface portion, which is inclined with respect to the axis of the plug and a second surface portion, which is substantially parallel to a plane orthogonal to the axis of the plug, the second surface portion having an initial stretch, in which said condition of engagement is rendered active, and a subsequent stretch, which enables said overtravel to be performed, wherein:

the second surface portion is as a whole longitudinally more extended than the first surface portion; and/or said subsequent stretch of the second surface portion is longitudinally more extended than said initial stretch of the second surface portion; and/or said subsequent stretch of the second surface portion is longitudinally more extended than the first surface portion.

18. The dispenser according to claim 1, wherein the means for mutual coupling comprise a bayonet-coupling arrangement.

19. The dispenser according to claim 1, comprising a system for detecting at least one of a condition of presence/absence of the plug in the charging passage and a condition of proper positioning of the plug so that it closes the charging passage, where in particular said detection system comprises at least one excitation element associated to the plug, which is able to co-operate with sensor means of the dispenser in order to generate a control signal.

20. A household dishwasher, comprising a device for dispensing washing agents according to claim 1.

* * * * *